US009199476B2

(12) United States Patent
Kodama et al.

(10) Patent No.: US 9,199,476 B2
(45) **Date of Patent: *Dec. 1, 2015**

(54) HOLDER HAVING DETACHABLE LIQUID HOUSING CONTAINER, AND LIQUID HOUSING CONTAINER

(71) Applicant: Seiko Epson Corporation, Tokyo (JP)

(72) Inventors: Hidetoshi Kodama, Matsumoto (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/582,052

(22) Filed: Dec. 23, 2014

(65) Prior Publication Data

US 2015/0109387 A1 Apr. 23, 2015

Related U.S. Application Data

(62) Division of application No. 13/224,288, filed on Sep. 1, 2011, now Pat. No. 8,950,851.

(30) Foreign Application Priority Data

Sep. 3, 2010 (JP) ..... 2010-197327

(51) Int. Cl.
*B41J 2/175* (2006.01)

(52) U.S. Cl.
CPC ..... *B41J 2/17523* (2013.01); *B41J 2/1752* (2013.01)

(58) Field of Classification Search
CPC ..... B41J 2/17523; B41J 2/1752
USPC ..... 347/85–87, 49
See application file for complete search history.

(56) References Cited

U.S. PATENT DOCUMENTS

| | | | | |
|---|---|---|---|---|
| 6,488,369 | B1 * | 12/2002 | Steinmetz et al. | 347/86 |
| 7,213,914 | B2 | 5/2007 | Anma et al. | |
| 8,529,036 | B2 * | 9/2013 | Kodama et al. | 347/86 |
| 8,950,851 | B2 * | 2/2015 | Kodama et al. | 347/85 |
| 2003/0063158 | A1 | 4/2003 | Browning et al. | |
| 2004/0135857 | A1 | 7/2004 | Hashii et al. | |
| 2005/0146580 | A1 | 7/2005 | Hashii et al. | |
| 2005/0151811 | A1 | 7/2005 | Shimizu et al. | |
| 2005/0185034 | A1 | 8/2005 | Anma et al. | |
| 2005/0200670 | A1 | 9/2005 | Hashii et al. | |

(Continued)

FOREIGN PATENT DOCUMENTS

| | | |
|---|---|---|
| EP | 1 547 782 A2 | 6/2005 |
| EP | 1 547 782 A3 | 6/2005 |

(Continued)

OTHER PUBLICATIONS

European search report, dated Nov. 11, 2013, of corresponding European Application No. 11179717.1. 7 pages.

(Continued)

*Primary Examiner* — Henok Legesse
(74) *Attorney, Agent, or Firm* — Kilpatrick Townsend & Stockton LLP

(57) ABSTRACT

A liquid housing container in which a liquid to be supplied to a head can be stored may be attached to or detached from a holder, which is provided to a liquid ejecting device having the head for ejecting a liquid. The holder has a rotation point where the mounted liquid housing container may be rotated in a predetermined so as to be detached from the holder.

15 Claims, 17 Drawing Sheets

(56) References Cited

U.S. PATENT DOCUMENTS

| | | | | |
|---|---|---|---|---|
| 2006/0152564 | A1 | 7/2006 | Hashii et al. | |
| 2007/0103515 | A1 | 5/2007 | Hashii et al. | |
| 2007/0103522 | A1 | 5/2007 | Hashii et al. | |
| 2007/0195141 | A1 | 8/2007 | Anma et al. | |
| 2007/0279464 | A1 * | 12/2007 | Harazim | 347/86 |
| 2009/0066768 | A1 | 3/2009 | Hashii et al. | |

FOREIGN PATENT DOCUMENTS

| | | | |
|---|---|---|---|
| JP | 2001-018416 | A | 1/2001 |
| JP | 1 424 202 | A1 | 6/2004 |
| JP | 2006-142483 | A | 6/2006 |
| JP | 2007-196664 | A | 8/2007 |
| JP | 2007-230248 | A | 9/2007 |
| JP | 2009-214548 | A | 9/2009 |
| JP | 2010-023458 | A | 2/2010 |
| WO | 2009/143422 | A2 | 11/2009 |

OTHER PUBLICATIONS

Extended European search report, dated May 22, 2014, of corresponding European Application No. 11179717.1.

Non-Final Rejection in related U.S. Appl. No. 13/224,288 dated Sep. 10, 2013—7 pages.

Non-Final Rejection in related U.S. Appl. No. 13/224,288 dated May 15, 2014—16 pages.

Notice of Allowance in related U.S. Appl. No. 13/224,288 dated Sep. 26, 2014—13 pages.

European search report, dated Mar. 1, 2013, of European Application No. 11179712.2.

* cited by examiner

HOLDER HAVING DETACHABLE LIQUID HOUSING CONTAINER, AND LIQUID HOUSING CONTAINER

This application is a divisional of U.S. patent application Ser. No. 13/224,288, filed Sep. 1, 2011, which claims the priority to Japanese Patent Application No. 2010-197327, filed Sep. 3, 2010, the entire disclosures of which are incorporated by reference herein.

BACKGROUND

1. Technical Field

The present invention relates to a holder having a detachable liquid housing container, and a liquid housing container.

2. Related Art

A printer which is one example of a liquid ejecting apparatus ejects an ink from a print head to a subject to be printed (for example, printing paper) and performs printing. The technique of using an ink cartridge containing an ink therein is known as an ink supplying technique for the print head (for example, JP-A-2006-142483). In detail, the ink is supplied from the ink cartridge to the print head by mounting the ink cartridge to a holder to which the print head is installed.

The holder may be formed to be detachable from the ink cartridge so that a user may exchange the ink cartridge when the amount of ink is deficient in the ink cartridge.

JP-A-2007-230248 and JP-A-2010-23458 are also examples of the related art.

However, there is still scope for improvement of the manipulation when the ink cartridge is attached to or detached from the holder. For example, a user may find it troublesome when manipulating to detach the ink cartridge from the holder. In particular, in a case where the ink cartridge engages with the holder, it is required to release the engagement so that the ink cartridge is detached from the holder, but a user may find it troublesome in this manipulation.

In addition, when the ink cartridge is attached to the holder, according to the installation order, a part of the ink cartridge may contact the inner wall surface of the holder before the ink cartridge is mounted, which may disturb the insertion of the ink cartridge.

In addition, in order to improve the manipulation, it is possible to divide the holder and provide a wall therebetween. In this case, there may be a problem in that the size of the holder may increase.

The manipulation of attachment/detachment as described above is a common issue of a liquid housing container which is detachably mounted to a liquid ejecting apparatus and a holder to which the liquid housing container may be detachably mounted, without being limited to an ink cartridge and a holder to which the ink cartridge may be detachably mounted.

SUMMARY

An advantage of some aspects of the invention is to provide a holder to which the liquid housing container may be detachably mounted, which has an improved manipulation in attaching or detaching the liquid housing container. In addition, another advantage of some aspects of the invention is to provide a liquid housing container detachably mounted to the holder, which has an improved manipulation for attachment to and detachment from the holder.

The invention is directed to solve at least a part of the above problems and it may be implemented as the following aspects and applications.

Application 1

A holder is provided to a liquid ejecting device having a head for ejecting a liquid and a liquid housing container capable of storing a liquid to be supplied to the head is attachable to or detachable from the holder, wherein the holder has a rotation point for rotating the mounted liquid housing container in a predetermined direction so as to be detached from the holder.

According to the holder of Application 1, since the holder has the rotation point for detaching the liquid housing container, a user may easily detach the liquid housing container from the holder by rotating the liquid housing container.

Application 2

The holder according to Application 1 further includes a device-side bottom wall surface portion which forms a bottom surface; a device-side engagement unit engaged with the liquid housing container to regulate movement of the liquid housing container; and an opposite wall surface portion installed to stand from the device-side bottom wall surface portion and located to face the device-side engagement unit while the device-side bottom wall surface portion is interposed therebetween, wherein the rotation point is formed at the opposite wall surface portion so that the liquid housing container rotates in the predetermined direction centered around the rotation point by adding a force to the liquid housing container in a direction in which the engagement is released.

According to the holder of Application 2, the manipulation for releasing the engagement of the holder and the liquid housing container and the manipulation for detaching the liquid housing container from the holder may be performed in series. By doing so, the manipulation when the liquid housing container is detached from the holder may be improved.

Application 3

In the holder according to Application 2, the liquid housing container attached to or detached from the holder includes a container body having a first wall surface portion which becomes a bottom surface when the liquid housing container is mounted to the holder, a second wall surface portion connected to the first wall surface portion, and a third wall surface portion connected to the first wall surface portion and facing the second wall surface portion, wherein, with respect to a usage posture of the liquid ejecting device, the opposite wall surface portion includes: an opposite surface extending upwards from the device-side bottom wall surface portion, the opposite surface being approximately parallel with an outer surface of the third wall surface portion when the liquid housing container is mounted; and an extension surface which extends from an upper end of the opposite surface in a direction away from the outer surface of the third wall surface portion, wherein the rotation point is defined by a border of the opposite surface and the extension surface.

According to the holder of Application 3, the rotation point may be easily formed using the opposite wall surface portion of the holder.

Application 4

In the holder according to Application 2, the liquid housing container attached to or detached from the holder includes a container body having a first wall surface portion which becomes a bottom surface when the liquid housing container is mounted to the holder, a second wall surface portion connected to the first wall surface portion, and a third wall surface portion connected to the first wall surface portion and facing the second wall surface portion, wherein, with respect to a usage posture of the liquid ejecting device, the opposite wall surface portion includes an opposite surface which extends upward from the device-side bottom wall surface portion and which is approximately parallel with an outer surface of the third wall surface portion when the liquid housing container is mounted, and wherein a space portion is formed above the opposite surface to receive a part of the liquid housing container so that the liquid housing container is allowed to rotate.

According to the holder of Application 4, the rotation point may be easily formed by means of the space portion and the opposite surface which is one surface of the opposite wall surface portion.

Application 5

In the holder according to any one of Applications 2 to 4, with respect to a usage posture of the liquid ejecting device, the rotation point is located below an engagement point where the liquid housing container is engaged with the device-side engagement unit.

According to the holder of Application 5, by adding an external force in a predetermined direction to a region located above the engagement point of the liquid housing container, the engagement of the holder and the liquid housing container may be released, and the liquid housing container may be rotated and detached from the holder. By doing so, the manipulation when the liquid housing container is detached from the holder may be further improved.

Application 6

In the holder according to any one of Applications 2 to 5, the opposite wall surface portion has a hole portion located closer to the device-side bottom wall surface portion than the rotation point so that a protrusion unit provided to the liquid housing container is inserted thereto to regulate movement of the liquid housing container after being mounted.

According to the holder of Application 6, the movement of the liquid housing container may be regulated by the hole portion after the liquid housing container is mounted, and the protrusion unit of the liquid housing container may be pulled out from the hole portion by rotating the liquid housing container in order to detach the liquid housing container.

Application 7

In the holder according to Application 6, the opposite wall surface portion has a guide channel for guiding the protrusion unit to the hole portion while regulating the movement of the liquid housing container in a width direction by the protrusion unit, when the liquid housing container is mounted.

According to the holder of Application 7, in a case where the liquid housing container is mounted to the holder, a user may easily guide the protrusion unit of the liquid housing container to the hole portion of the holder by inserting the protrusion unit of the liquid housing container into the guide channel. Therefore, the manipulation when the liquid housing container is mounted to the holder may be improved.

Application 8

In the holder according to Application 7, with respect to a usage posture of the liquid ejecting device, the guide channel is formed over the hole portion from an upper end of the opposite wall surface portion.

According to the holder of Application 8, since the upper end of the guide channel is located at the upper end of the opposite wall surface portion, a user may easily insert the protrusion unit of the liquid housing container into the guide channel.

Application 9

In the holder according to Application 7 or 8, with respect to a usage posture of the liquid ejecting device, the width of the upper end of the guide channel is greater than a width of the lower end of the guide channel.

According to the holder of Application 9, since the upper end of the guide channel has a greater width, a user may more easily insert the protrusion unit of the liquid housing container into the guide channel.

Application 10

In the holder according to any one of Applications 7 to 9, the width of the guide channel monotonously decreases as the hole portion gets closer.

According to the holder of Application 10, a user may easily insert the protrusion unit of the liquid housing container into the guide channel and may accurately guide the protrusion unit toward the hole portion.

Application 11

In the holder according to any one of Applications 7 to 10, the guide channel has a lower guide channel having a tapered shape whose width gradually decreases as the hole portion gets closer.

According to the holder of Application 11, a user may smoothly guide the protrusion unit of the liquid housing container to the hole portion by means of the lower guide channel.

Application 12

In the holder according to any one of Applications 7 to 11, with respect to a usage posture of the liquid ejecting device, the lower end of the guide channel has the same width as the width of the hole portion.

According to the holder of Application 12, the protrusion unit of the liquid housing container may be more smoothly guided from the guide channel to the hole portion.

Application 13

In the holder according to any one of Applications 7 to 12, a channel bottom wall surface portion which forms a bottom surface of the guide channel and is opposite to the liquid housing container has a deformation unit which is elastically deformable in the depth direction of the guide channel, and with respect to a usage posture of the liquid ejecting device, the lower end of the deformation unit may reach the hole portion.

According to the holder of Application 13, as the deformation unit is provided, before the liquid housing container is mounted to the holder, the possibility that the movement of the liquid housing container in the holder is restricted may be decreased.

Application 14

In the holder according to Application 13, with respect to a usage posture of the liquid ejecting device, among the region of the channel bottom wall surface portion, the upper end of the deformation unit reaches a location higher than an intersection point where the channel bottom wall surface portion intersects a trajectory along which the protrusion unit rotates centered around an engagement point where the liquid housing container is engaged, before the protrusion unit of the liquid housing container is inserted into the hole portion, in a case where a container-side regulating unit of the liquid housing container which is to be engaged with the device-side engagement unit is engaged with the device-side engagement unit.

According to the holder of Application 14, before the protrusion unit is inserted into the hole portion, even when the container-side regulating unit of the liquid housing container is engaged with the device-side engagement unit, the possibility that the movement of the liquid housing container is restricted in the holder may be decreased.

Application 15

In the holder according to Application 13 or 14, the deformation unit is obtained by forming notches at both ends of the channel bottom wall surface portion.

According to the holder of Application 15, the deformation unit may be formed with a simple configuration by forming notches at both ends of the channel bottom wall surface portion.

Application 16

In the holder according to any one of Application 2 to 15, the device-side bottom wall surface portion includes a first device-side regulating unit which regulates the movement of the liquid housing container at least in a width direction by cooperating with a first regulating unit of the liquid housing container.

According to the holder of Application 16, the movement of the liquid housing container after being mounted may be suppressed.

Application 17

In the holder according to Application 16, the first device-side regulating unit has a protrusive shape into which the first regulating unit which is a notch is inserted.

According to the holder of Application 17, since the notch for regulating the movement in the width direction is installed to the liquid housing container which moves with respect to the holder when being mounted, the possibility that the mounting operation of the liquid housing container is restricted may be decreased rather than the case where the protrusion unit is installed instead of the notch.

Application 18

A liquid ejecting device has the holder according to any one of Applications 1 to 17.

According to the liquid ejecting device of Application 18, it is possible to provide a liquid ejecting device equipped with the holder with an improved manipulation when the liquid housing container is attached or detached.

Application 19

A liquid housing container is attachable to and detachable from a liquid ejecting device having a head for ejecting a liquid, the liquid housing container including: a container body which forms a liquid receiving chamber for receiving a liquid therein and includes a first wall surface portion which becomes a bottom surface when the liquid ejecting device is mounted to a holder, a second wall surface portion connected to the first wall surface portion, and a third wall surface portion connected to the first wall surface portion to face the second wall surface portion; and an elastic portion having one end mounted to the second wall surface portion and having elasticity, the elastic portion being used for attachment to or detachment from the holder, wherein the elastic portion includes: a container-side regulating unit engaged with the holder to regulate the movement of the liquid housing container; and an engagement releasing unit provided above the container-side regulating unit and elastically deformed by an external force added thereto in a direction of pressing against the second wall surface portion to release the engagement, the engagement releasing unit allowing the liquid housing container to be detached from the holder by rotating the liquid housing container centered around a rotation point which is a contact portion of the third wall surface portion and the holder located below the engagement point.

According to the liquid housing container of the Application 19, the liquid housing container may be rotated to release the engagement of the liquid housing container by the engagement releasing unit and to detach the liquid housing container from the holder.

Application 20

In the liquid housing container according to Application 19, the engagement releasing unit includes a first side surface opposite to the second wall surface portion and a second side surface opposite to the first side surface, and, in a case where the first side surface contacts the second wall surface portion, the second side surface is formed to be closer to the rotation point from the upper end to the lower end with respect to the direction in which the second and third wall surface portions are opposite.

According to the liquid housing container of Application 20, the second side surface is formed to be closer to the rotation point from the upper end to the lower end. Therefore, by applying an external force to the engagement releasing unit in the direction approaching the second wall surface portion (the length direction of the liquid housing container), the force in the rotation direction for rotating and detaching the liquid housing container may be efficiently transferred to the engagement releasing unit. By doing so, the liquid housing container may be rotated by the operation for releasing the engagement so that the liquid housing container may be easily detached from the holder.

Further, the invention may be implemented in various ways, and in addition to the liquid ejecting device equipped with the holder and the liquid housing container, the invention may be implemented as a method for manufacturing the holder having the above distinctive configuration and a method for manufacturing the liquid housing container having the above distinctive configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order.

A. First Embodiment

B. Second Embodiment

C. Modified Example

A. First Embodiment

A-1. Configuration of Liquid Ejecting Apparatus

Figure 1:
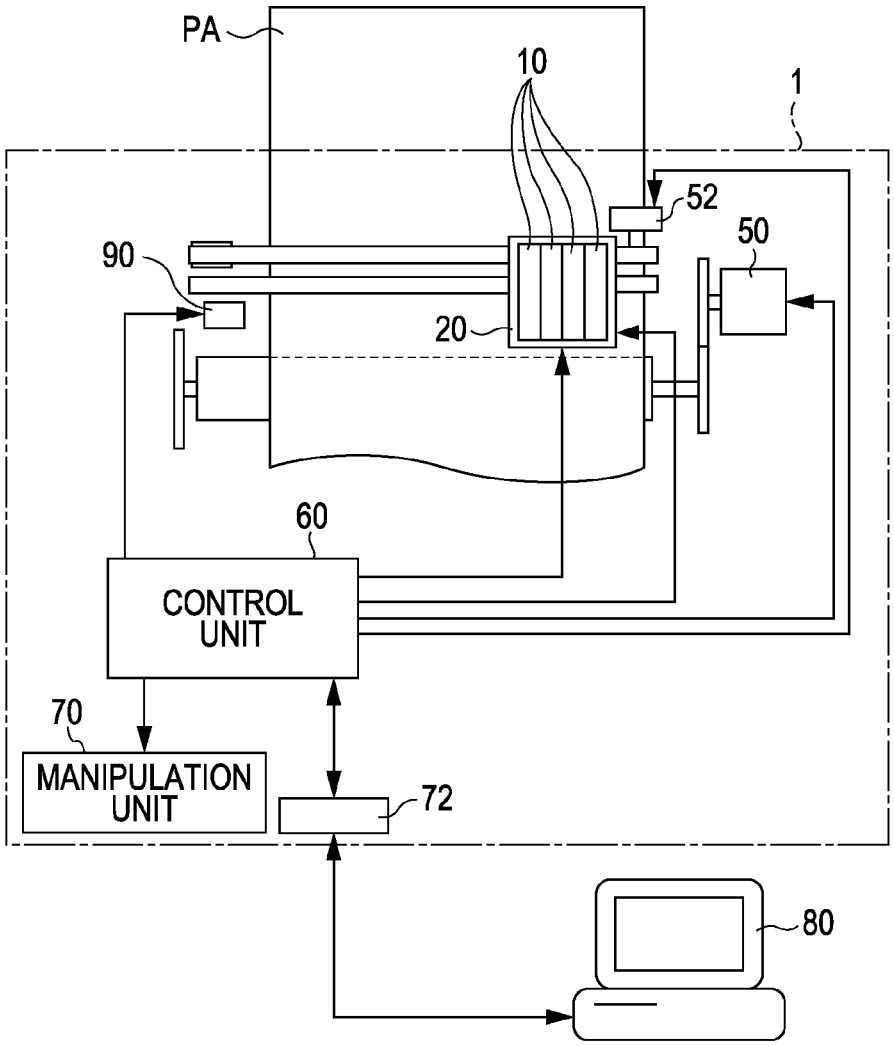
FIG. 1 is a schematic diagram showing a liquid ejecting apparatus.

FIG. 1 is a schematic diagram showing a liquid ejecting apparatus 1 having a liquid housing container 10 and a holder 20 as a first embodiment of the invention. The liquid ejecting apparatus 1 is an ink jetprinter 1 (hereinafter, referred to as just a "printer 1") which ejects an ink to a printing paper PA to perform printing. The printer 1 includes an ink cartridge 10 serving as a liquid housing container, a holder 20, a first motor 52, a second motor 50, a control unit 60, a manipulation unit 70, a predetermined interface 72, and an optical detection device 90. In addition, hereinafter, the ink cartridge 10 is simply called a "cartridge 10".

The holder 20 has a print head (not shown) for ejecting an ink to the printing paper PA and its opposite side. In addition, the cartridge 10 is detachably loaded to the holder 20. In each cartridge 10, an ink of cyan, magenta, yellow or the like is received, respectively. The ink received in the cartridge 10 is supplied to the print head of the holder 20 so that the ink is ejected to the printing paper PA.

The first motor 52 drives the holder 20 in a main scanning direction. The second motor 50 feeds the printing paper PA in a sub-scanning direction. The control unit 60 controls overall operations of the printer 1.

The optical detection device 90 is fixed at a predetermined location. When the holder 20 is moved to a predetermined location, the optical detection device 90 irradiates light toward the cartridge 10 in order to detect the remaining amount of the ink. In addition, the details will be described later.

The control unit 60 controls the first motor 52, the second motor 50 and the print head based on printing data received from a computer 80 or the like connected thereto via the predetermined interface 72 to perform printing. The control unit 60 is connected to the manipulation unit 70 to receive various manipulations from a user.

Figure 2:
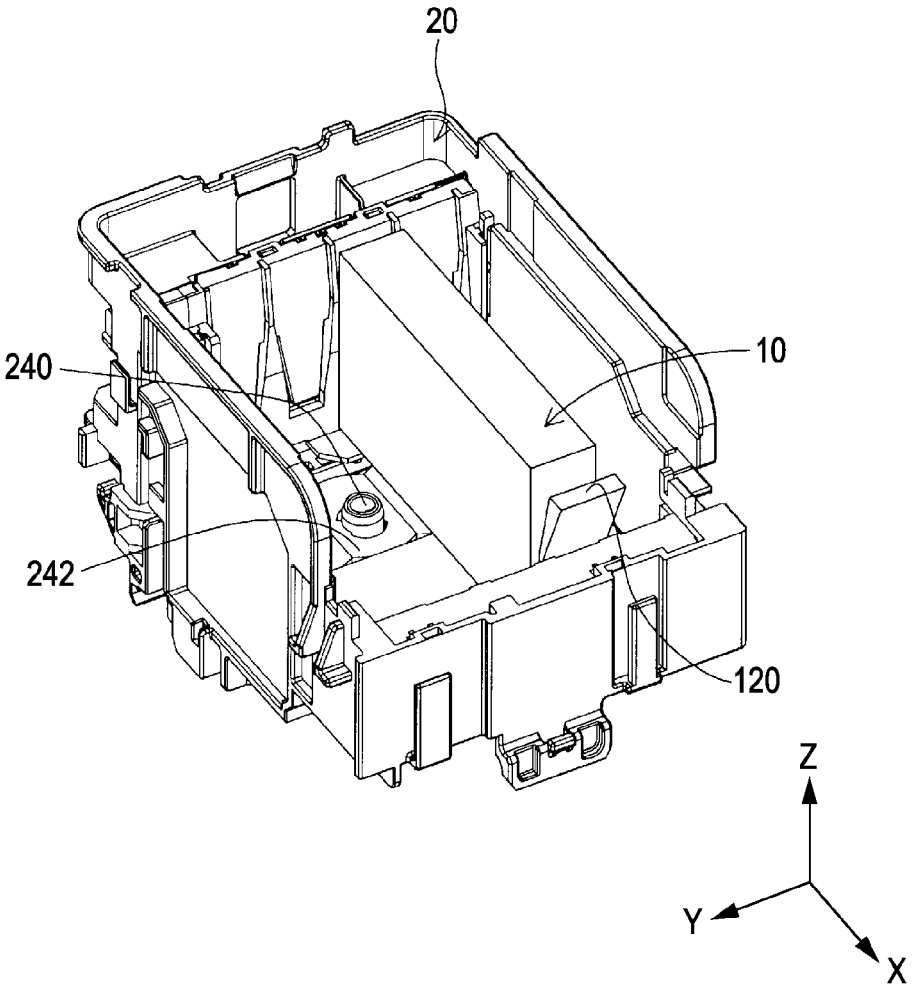
FIG. 2 is a perspective view showing an appearance of a holder to which a cartridge is mounted.

FIG. 2 is a perspective view showing an appearance of the holder 20 to which the cartridge 10 is mounted. For ease of description, FIG. 2 shows that one cartridge 10 is mounted to the holder 20. In addition, in order to specify directions, X, Y and Z axes orthogonal to each other are depicted in FIG. 2. The X, Y and Z axes orthogonal to each other are also given to following figures as necessary.

The holder 20 is configured so that four cartridges 10 may be mounted. In addition, the number of cartridges 10 which can be mounted to the holder 20 is not limited to four, and the configuration of the holder 20 may be changed according to the number of required cartridges 10. Regarding the posture of the printer 1 in use, the Z-axis direction becomes a vertical direction, and the negative Z-axis negative direction becomes a vertical downward direction. In addition, the main scanning direction of the printer 1 becomes a Y-axis direction.

The holder 20 has a liquid supply tube 240. The liquid supply tube 240 communicates the print head of the holder 20 with the cartridge 10. The ink in the cartridge 10 is communicated with the print head via the liquid supply tube 240. In addition, an elastic member 242 is installed around the liquid supply tube 240 so that the ink does not leak out. The cartridge 10 has a lever 120 which is an elastic portion that is elastically deformed. A user may detach the cartridge 10 from the holder 20 by manipulating the elastic portion 120. In addition, the attaching/detaching manipulation of the cartridge 10 to/from the holder 20 will be described in detail later.

A-2. Configuration of Cartridge

Figure 3B:
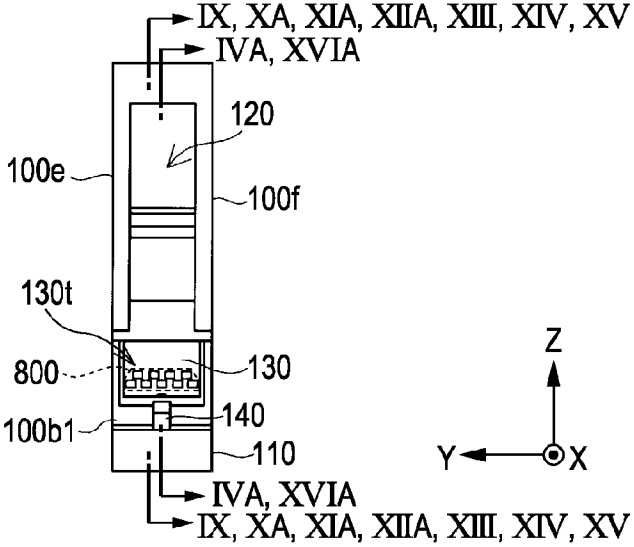
FIGS. 3A to 3D are first diagrams for illustrating the cartridge.
Figure 3A:
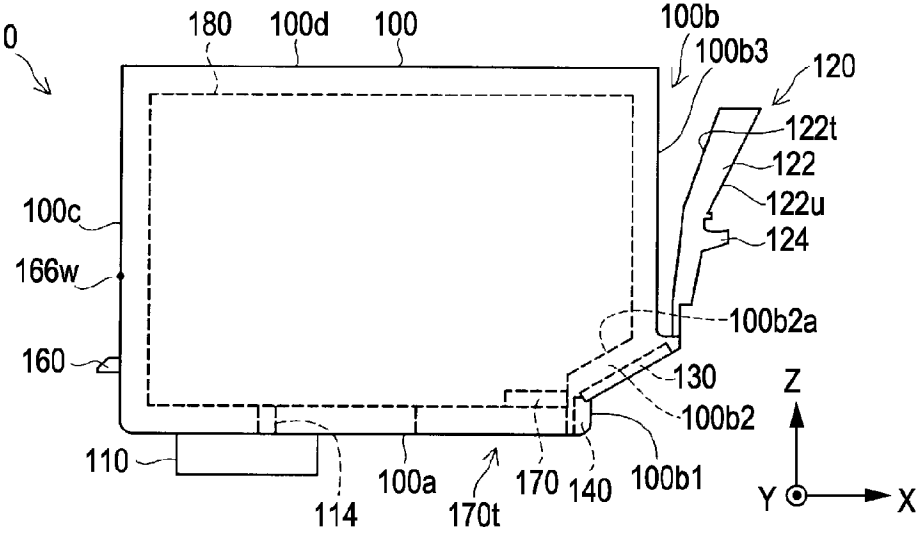
Figure 3D:
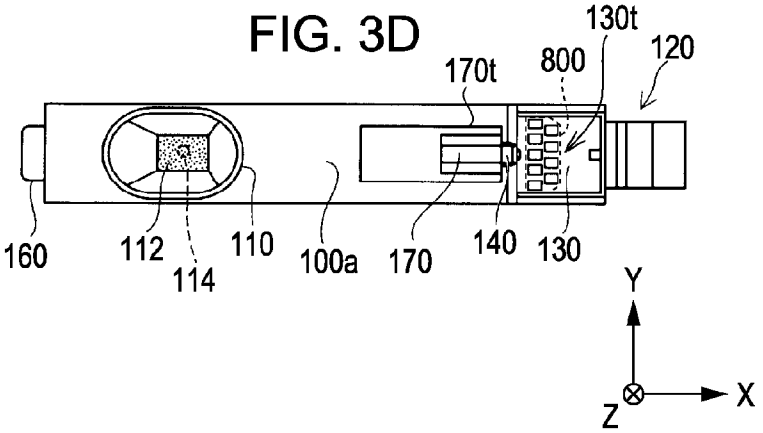
Figure 3C:
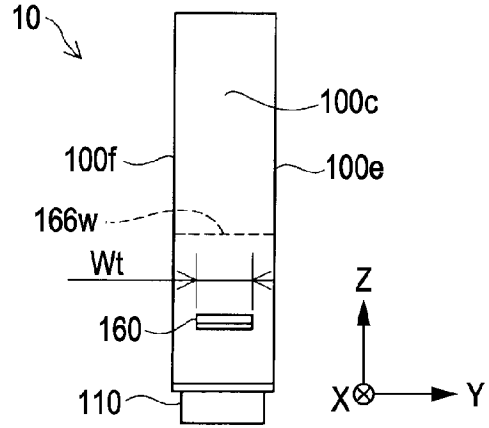
Figure 4A:
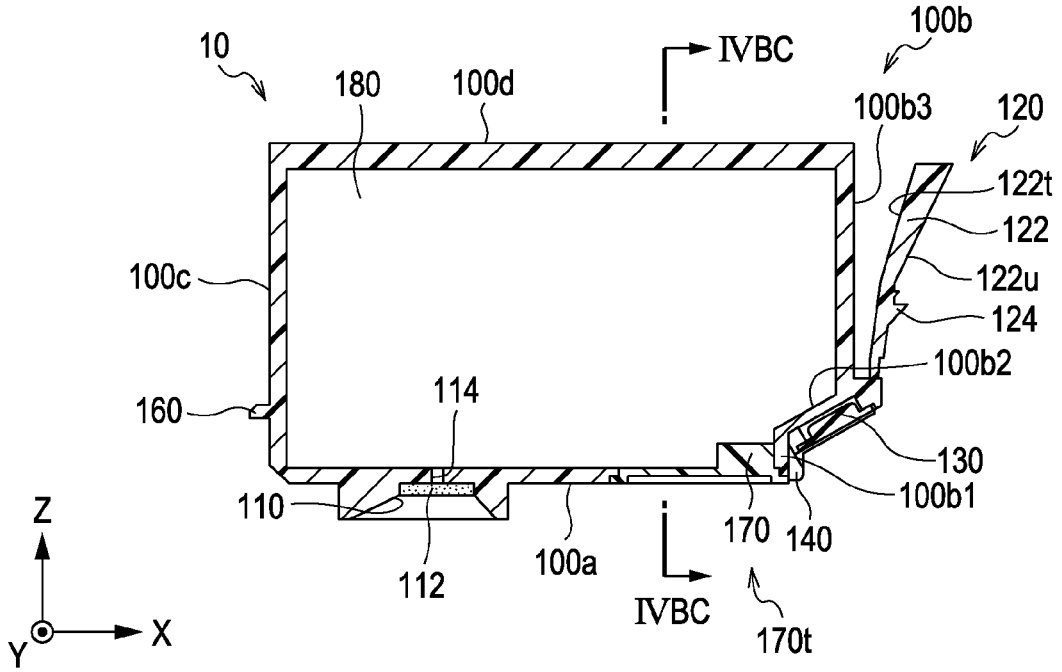
FIGS. 4A to 4C are second diagrams for illustrating the cartridge.
Figure 4B:
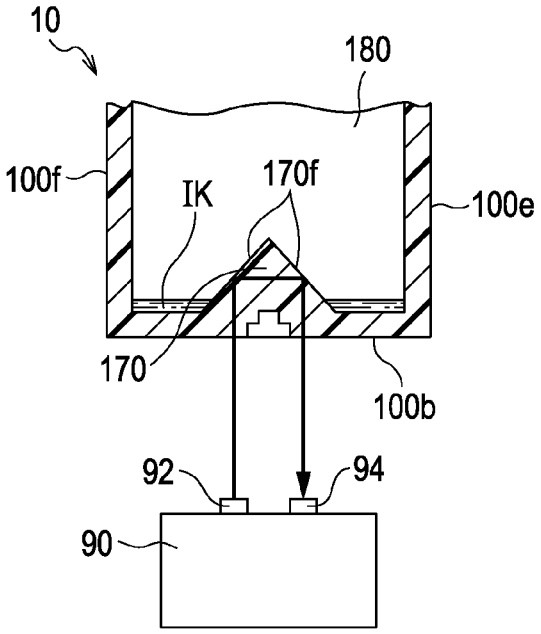
Figure 4C:
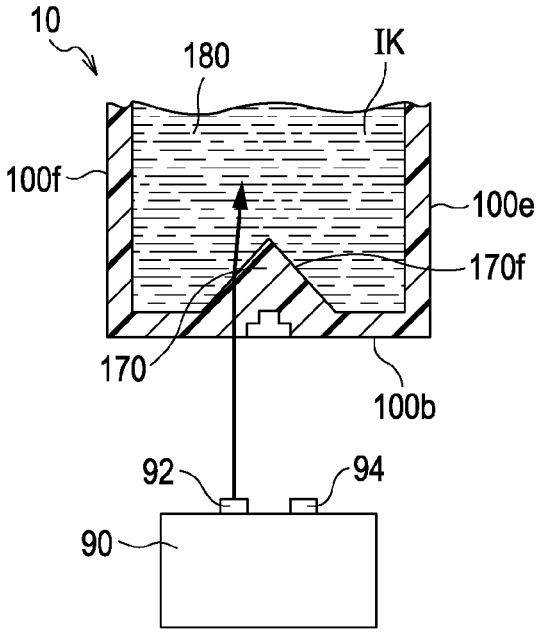

Next, the configuration of the cartridge 10 will be described with reference to FIGS. 3A to 4C. FIGS. 3A to 3D are drawings for illustrating the cartridge 10. FIG. 3A is a side view of the cartridge 10. FIG. 3B is a front view of the cartridge 10. FIG. 3C is a rear view of the cartridge 10. FIG. 3D is a bottom view of the cartridge 10. FIGS. 4A to 4C are second drawings for illustrating the cartridge 10. FIG. 4A is a sectional view taken along the line IVA-IVA of FIG. 3B. FIGS. 4B and 4C are drawings for illustrating a method for detecting a remaining amount of ink. In FIGS. 4B and 4C, the sectional view of the cartridge 10 taken along the line IVBC-IVBC of FIG. 4A is shown.

As shown in FIGS. 3A, 3B and 3D, the cartridge 10 includes a container body 100, a lever 120, a liquid supply hole 110, a circuit board 130, and a prism unit 170*t*. The container body 100, the lever 120 and the liquid supply hole 110 are formed with a synthetic resin such as polypropylene or the like.

As shown in FIGS. 3A to 3D, the container body 100 has a first wall surface portion (also called a "bottom surface portion") 100*a*, a second wall surface portion (also called a "front surface portion") 100*b*, a third wall surface portion (also called a "rear surface portion") 100*c*, a fourth wall surface portion (also called an "upper surface portion") 100*d*, a fifth wall surface portion (also called a "left side surface portion") 100*e*, and a sixth wall surface portion (also called a "right side surface portion") 100*f*. The container body 100 has a liquid receiving chamber 180 formed by the first to sixth wall surface portions 100*a* to 100*f* to receive an ink therein (FIG. 3A).

The first wall surface portion 100*a* is a wall surface portion at the Z-axis negative direction with respect to the liquid receiving chamber 180. The second wall surface portion 100*b* is a wall surface portion at the X-axis positive direction with respect to the liquid receiving chamber 180. The third wall surface portion 100*c* is a wall surface portion at the X-axis negative direction with respect to the liquid receiving chamber 180. The fourth wall surface portion 100*d* is a wall surface portion at the Z-axis positive direction with respect to the liquid receiving chamber 180. The fifth wall surface portion 100*e* is a wall surface portion at the Y-axis positive direction with respect to the liquid receiving chamber 180. The sixth wall surface portion 100*f* is a wall surface portion at the Y-axis negative direction with respect to the liquid receiving chamber 180. In addition, with respect to the cartridge 10, the direction (Z-axis direction) in which the first wall surface portion 100*a* is opposite to the fourth wall surface portion 100*d* is set to be the height direction. In addition, the direction (X-axis direction) in which the second wall surface portion 100*b* is opposite to the third wall surface portion 100*c* is set to be the length direction. In addition, the direction (Y-axis direction) in which the fifth wall surface portion 100*e* is opposite to the sixth wall surface portion 100*f* is set to be the width direction.

The first wall surface portion 100*a* configures an approximately rectangular bottom surface at both inner and outer surfaces with respect to a mounting posture to the holder 20. The fourth wall surface portion 100*d* is a wall surface portion opposite to the first wall surface portion 100*a* and configures an approximately rectangular top surface at both inner and outer surfaces with respect to the mounting posture. The outer surfaces of the first and fourth wall surface portions 100*a* and 100*d* become parallel surfaces with respect to the mounting posture.

As shown in FIGS. 3A to 3D, the second, third, fifth and sixth wall surface portions 100*b*, 100*c*, 100*e* and 100*f* are respectively connected to sides (four sides) of the first and fourth wall surface portions 100*a* and 100*d*. In other words, the second, third, fifth and sixth wall surface portions 100*b*, 100*c*, 100*e* and 100*f* are installed to stand from the first wall surface portion 100*a*. Among them, the third, fifth and sixth wall surface portions 100*c*, 100*e* and 100*f* perpendicularly intersect the first and fourth wall surface portions 100*a* and 100*d*. Namely, the outer surface of each wall surface portion 100*c*, 100*e* and 100*f* is perpendicular to the horizontal surface with respect to the mounting posture. The second wall surface portion 100*b* is opposite to the third wall surface portion 100*c*. In addition, the fifth wall surface portion 100*e* is opposite to the sixth wall surface portion 100*f*.

As shown in FIG. 3A, the second wall surface portion 100*b* has a first vertical wall portion 100*b*1, a slanted wall portion 100*b*2 and a second vertical wall portion 100*b*3. With respect the mounting posture, the first vertical wall portion 100*b*1 is located at the lowermost region of the second wall surface portion 100*b* in a right vertical direction and stands in a right upward direction from the first wall surface portion 100*a*. The second vertical wall portion 100*b*3 is located at the uppermost region of the second wall surface portion 100*b* and is perpendicular to the fourth wall surface portion 100*d*. The slanted wall portion 100*b*2 has one end connected to the first vertical wall portion 100*b*1 and the other end connected to the second vertical wall portion 100*b*3. The slanted wall portion 100*b*2 is slanted so that the ink near the second wall surface portion 100*b* of the liquid receiving chamber 180 flows toward the liquid supply hole 110. In other words, the slanted wall portion 100*b*2 has an inner surface 100*b*2*a* which is slanted closer to the liquid supply hole 110 from the other end which is an upper end to one end which is a lower end. In addition, the outer surface of the slanted wall portion 100*b*2 is also slanted similarly to the inner surface 100*b*2*a*.

As shown in FIG. 3A, the liquid supply hole 110 is installed in the first wall surface portion 100*a* so that the ink in the liquid receiving chamber 180 flows outwards. The liquid supply hole 110 is installed at a partial center of the first wall surface portion 100*a*, at a portion closer to the third wall surface portion 100*c* rather than the second wall surface portion 100*b*. The liquid supply hole 110 communicates with a flow channel 114 formed in the first wall surface portion 100*a* so that the ink in the liquid receiving chamber 180 flows outwards (toward the print head, in this embodiment). As shown in FIGS. 3D and 4A, a sponge foam 112 is disposed in the liquid supply hole 110 to prevent the ink from leaking out of the liquid supply hole 110.

As shown in FIGS. 3A, 3D and 4A, the prism unit 170*t* is further disposed at the first wall surface portion 100*a*. The prism unit 170*t* is formed transparently by polypropylene. As shown in FIGS. 4A to 4C, the prism unit 170*t* has a prism 170 used for detecting a remaining amount of ink. The prism 170 has a right isosceles triangular prism shape and is disposed so that a reflective surface 170*f* (FIGS. 4B and 4C) is located in the liquid receiving chamber 180. In addition, as shown in FIG. 4A, the prism 170 is disposed to contact the inner surface of the second wall surface portion 100*b* (in detail, the first vertical wall portion 100*b*1). By disposing as described above, it is possible to prevent the ink flowing from the second wall surface portion 100*b* to the liquid supply hole 110 from being blocked by the prism 170. By doing so, the remaining amount of ink staying in the liquid receiving chamber 180 may be reduced so that the ink may be consumed efficiently.

The prism 170 reflects light variously in response to the refractive index of the fluid which contacts the reflective surface 170*f*. As shown in FIG. 4B, in a case where the remaining amount of ink decreases so that the reflective surface 170*f* contacts the air, the light irradiated from a light emitting element 92 is reflected by the reflective surface 170*f* of the prism 170 and is incident to a light receiving element 94 due to the difference in refractive indexes of the prism 170 and the air. Meanwhile, as shown in FIG. 4C, in a case where the ink is present in the liquid receiving chamber 180 so that the reflective surface 170*f* contacts the ink IK, since the reflective indexes of the prism 170 and the ink are identical, the light irradiated from the light emitting element 92 is refracted a little by the reflective surface 170*f* as shown in FIG. 4C and advances into the ink IK. In other words, the remaining amount of ink may be detected by measuring the light which is incident to the light receiving element 94.

As shown in FIGS. 3A, 3B and 4A, a notch (channel) 140 is formed in the first vertical wall portion 100*b*1 of the second wall surface portion 100*b*. The notch 140 is installed at a position closer to the first wall surface portion 100*a* than a position where a terminal group 130*t* is installed. In detail, with respect to the height direction (the Z-axis direction), the notch 140 is installed at a location closer to the first wall surface portion 100*a* than a location where the terminal group 130*t* is installed. In addition, as shown in FIG. 3B, the notch 140 is installed at the approximate center of the first vertical wall portion 100*b*1 in the width direction.

As shown in FIGS. 3A and 4A, the circuit board 130 having the terminal group 130*t* (which will be described later in detail) is installed to the slanted wall portion 100*b*2 of the second wall surface portion 100*b*. As shown in FIG. 3A, with respect to the length direction (the X-axis direction), the notch 140 is installed to partially overlap the circuit board 130. In other words, with respect to the mounted state where the cartridge 10 is mounted to the holder 20, the circuit board 130 is located right above the notch 140. In other words, when the cartridge 10 is vertically projected in the vertical direction (the Z-axis direction), the notch 140 is installed to partially overlap the circuit board 130. In addition, with respect to the length direction (the X-axis direction), the notch 140 is more preferably installed to overlap a part of the terminal group 130*t* of the circuit board 130. Here, the expression "the notch 140 overlaps a part of the terminal group 130*t* of the circuit board 130" means that "an inclusive region 800 surrounded by a minimal polygon (in detail, a convex polygon of which all inner angles are smaller than 180 degrees) including the terminal group 130*t* overlaps the notch 140 at least partially." When mounted to the holder 20, the circuit board 130 is electrically connected to the control unit 60 (FIG. 1) of the printer 1 to transmit various information (signals) with the printer 1. In addition, details of the circuit board 130 will be described later.

As shown in FIGS. 3A and 4A, the lever 120 is installed to the second wall surface portion 100*b*. Specifically, the lower end surface of the lever 120 is mounted to the slanted wall portion 100*b*2. In addition, the lever 120 extends upwards from the lower end surface. The lever 120 has elasticity such that the lever 120 is elastically deformed in the length direction (X-axis direction) by an external force. The lever 120 has a container-side regulating unit 124 and an engagement releasing unit 122. The container-side regulating unit 124 is engaged to the holder 20, described later, to regulate the movement of the cartridge 10 in the height direction. In detail, the container-side regulating unit 124 regulates the movement of the second wall surface portion 100*b* in the height direction. The engagement releasing unit 122 is a region to which an external force is applied by a user, and the engagement releasing unit 122 is used for releasing the engagement between the holder 20 and the container-side regulating unit 124. The engagement releasing unit 122 has a first side surface 122*t* which faces the second wall surface portion 100*b* and a second side surface 122*u* opposite to the first side surface 122*t*. When the first side surface 122*t* contacts the second wall surface portion 100*b*, the second side surface 122*u* is slanted to be closer to a rotation point 166*w*, described later, from the upper end to the lower end. The slant of the second side surface 122*u* in the above direction will be hereinafter referred to as a "lower slant".

As shown in FIGS. 3A, 3C and 4A, a protrusion unit 160 is installed at a center region of the third wall surface portion 100*c*, at a region where the height is half or less in the height direction. The protrusion unit 160 is used for regulating the movement of the cartridge 10 after the cartridge 10 is mounted to the holder 20. Specifically, the protrusion unit 160 regulates the movements of the third wall surface portion 100*c* of the cartridge 10 in the width direction and in the height direction. The protrusion unit 160 has a width Wt (FIG. 3C). The details will be described later.

As shown in FIGS. 3A and 3C, the third wall surface portion 100*c* has a rotation point 166*w* which will contact the holder 20 and become a point of rotation, when the cartridge 10 is detached from the holder 20 by rotation. This rotation point 166*w* is located below an engagement point where the holder 20 is engaged with the container-side regulating unit 124 in the height direction. In other words, the rotation point 166*w* is located below the engagement releasing unit 122 in the height direction. In addition, an atmosphere opening hole (not shown) for introducing air to the inside as the ink in the liquid receiving chamber 180 is consumed is formed in the third wall surface portion 100*c*.

Figure 5A:
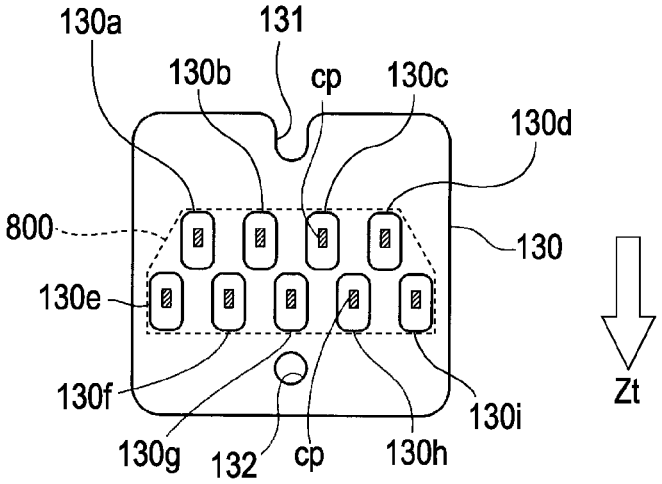
FIGS. 5A and 5B are diagrams for illustrating a circuit board.
Figure 5B:
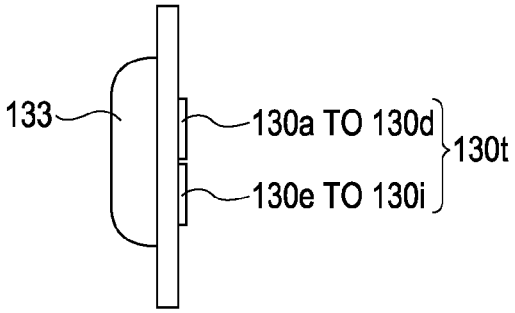

FIGS. 5A and 5B are diagrams for illustrating the circuit board 130. FIG. 5A shows the surface of the circuit board 130. FIG. 5B shows the circuit board 130, observed from the side. The surface of the circuit board 130 is a surface exposing to the outside when the circuit board 130 is mounted to the cartridge 10. In addition, the arrow Zt shown in FIG. 5A represents an inserting direction of the cartridge 10 to the holder 20.

As shown in FIG. 5A, a boss notch 131 is formed in the upper end portion of the circuit board 130, and a boss hole 132 is formed at the lower end portion of the circuit board 130. The boss notch 131 and the boss hole 132 are used for easily mounting the circuit board 130 to the container body 100.

The circuit board 130 has a terminal group 130*t* composed of nine terminals 130*a* to 130*i* disposed at the surface and a storage unit 133. The storage unit 133 disposed at the opposite surface stores information (for example, the remaining amount of ink or the ink color) about the ink of the cartridge 10. The terminals 130*a* to 130*i* have an approximately spherical shape and are arranged to form two rows which are approximately perpendicular to the inserting direction Zt. Among two rows, the row located at a rear side in the inserting direction Z, namely located at a lower side in FIG. 5A, is called a lower row (a first row), and the row located at a front side in the inserting direction Z, namely located at an upper side in FIG. 5A, is called an upper row (a second row). In addition, as described above, an appearance of the inclusive region 800 surrounded by a minimal convex polygon including the terminal group 130*t* is depicted with a dotted line. In this embodiment, the inclusive region 800 is a hexagon.

The center portion of each terminal 130*a* to 130*i* includes a contact portion cp which respectively contacts a corresponding terminal of the device, mounted to the holder 20. Each contact portion cp of the terminals 130*a* to 130*d* of the upper row and each contact portion cp of the terminals 130*e* to 130*i* of the lower row are arranged to cross each other into a so-called zigzag pattern. In addition, the terminals 130*a* to 130*d* of the upper row and the terminals 130*e* to 130*i* of the lower row are arranged to cross each other into a zigzag pattern so that the center of the terminals is not in line with the inserting direction Zt. In addition, the circuit board 130 is mounted to the cartridge 10 so that as many terminals as close to the notch 140 of the cartridge 10 are included. In other words, the circuit board 130 is mounted to the cartridge 10 so that the lower row (the first row) is located lower than the upper row (the second row) in the height direction of the cartridge 10.

The terminals 130*a* to 130*d* of the upper row and the terminals 130*e* to 130*i* of the lower row respectively have the following functions (usages).

<Upper Row>

(1) Mounting detection terminal 130*a*
(2) Reset terminal 130*b*
(3) Clock terminal 130*c*
(4) Mounting detection terminal 130*d*

<Lower Row>

(5) Mounting detection terminal 130*e*
(6) Power terminal 130*f*
(7) Grounding terminal 130*g*
(8) Data terminal 130*h*
(9) Mounting detection terminal 130*i*

Four mounting detection terminals 130*a*, 130*d*, 130*e* and 130*i* are used for detecting whether the electric contact with a terminal of the device is acceptable, and they may also be called "contact detection terminals". Five other terminals 130*b*, 130*c*, 130*f*, 130*g* and 130*h* are terminals for the storage unit 133.

A-3. Configuration of Holder

Figure 6A:
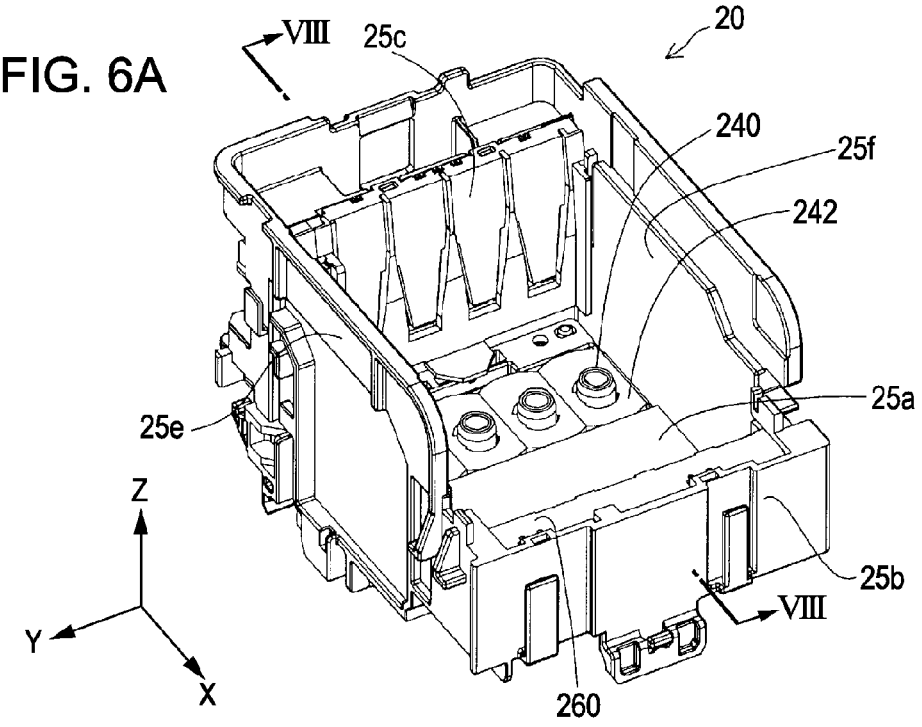
FIGS. 6A and 6B are diagrams for illustrating a holder.
Figure 6B:
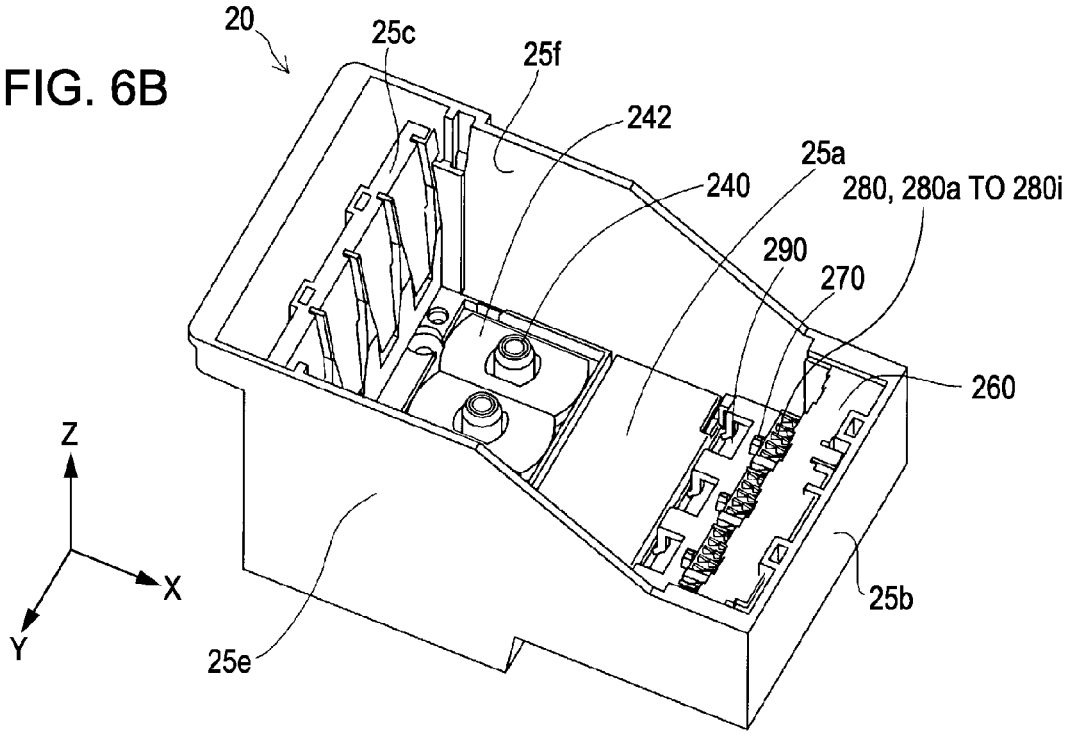
Figure 7A:
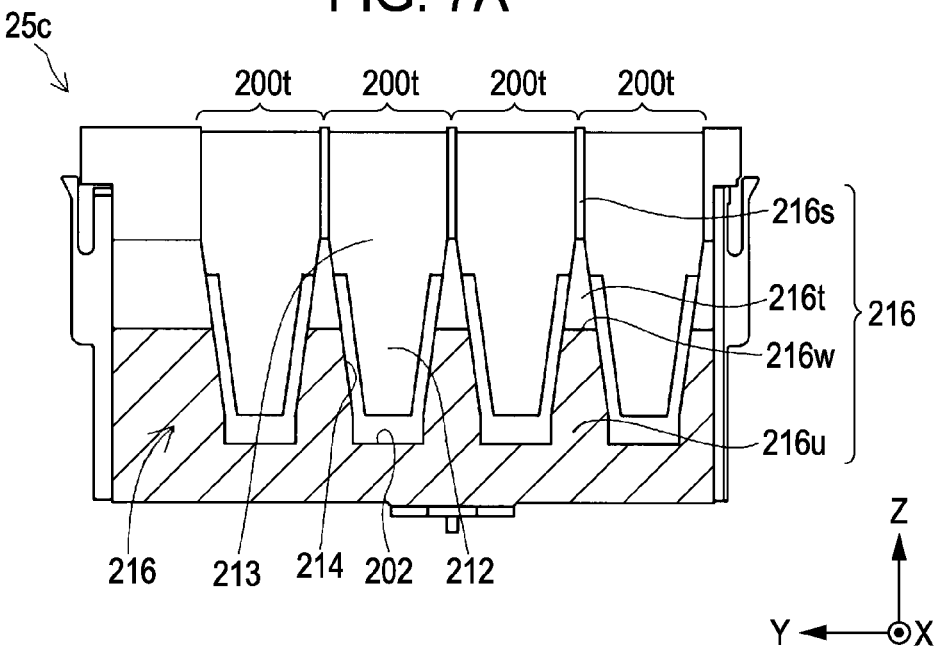
FIGS. 7A and 7B are diagrams for illustrating a detailed configuration of an opposite wall surface portion.
Figure 7B:
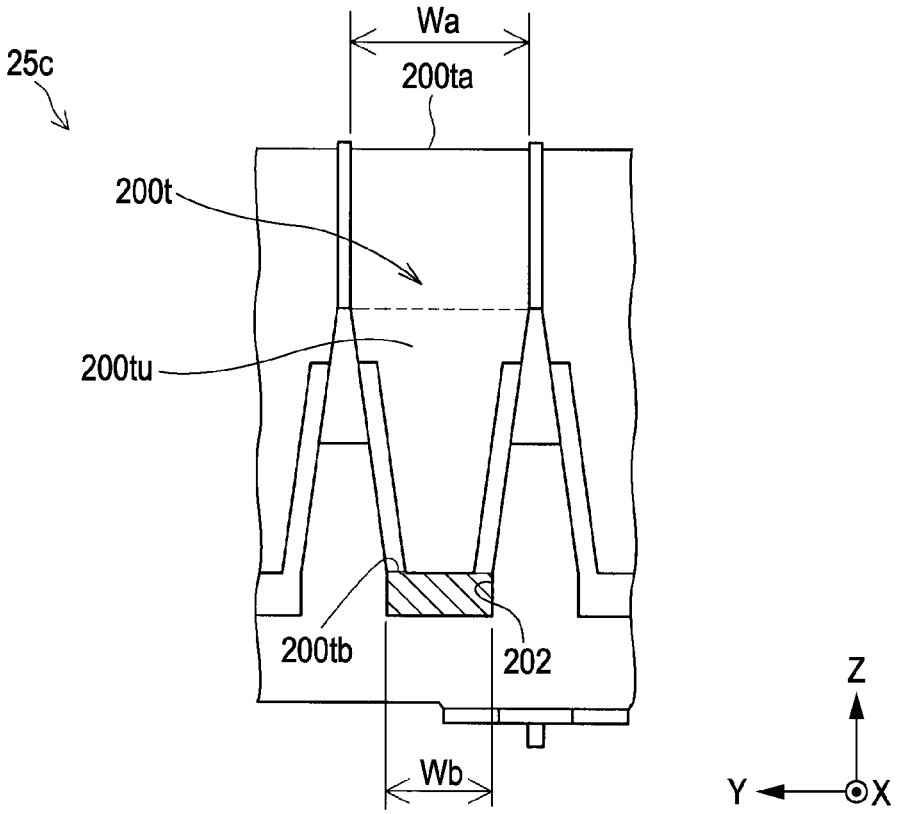
Figure 8:
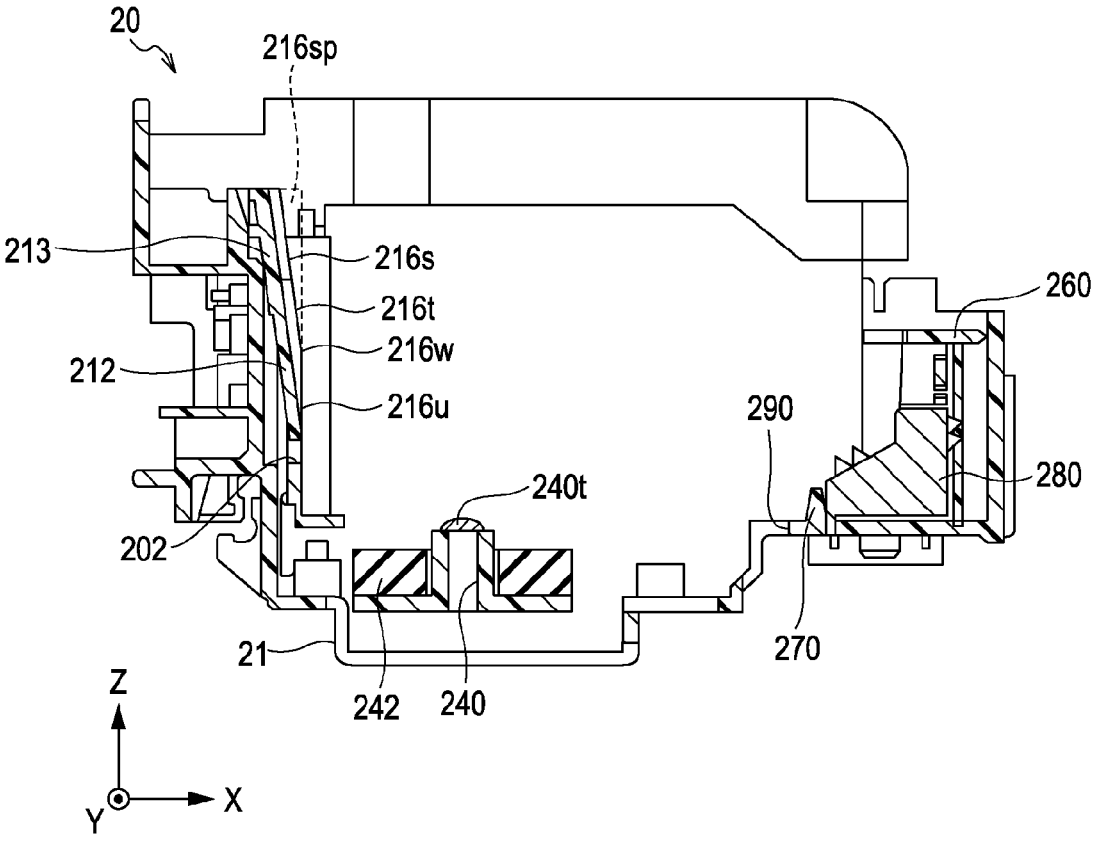
FIG. 8 is a sectional view taken along the line VIII-VIII of FIG. 6A.

Next, the detailed configuration of the holder 20 will be described with reference to FIGS. 6A to 8. FIGS. 6A and 6B are diagrams for illustrating the holder 20. FIG. 6A is a first perspective view showing an appearance of the holder 20, and FIG. 6B is a second perspective view showing the appearance of the holder 20. In addition, the second perspective view does not show a part of the outer circumferential wall of the holder 20 for the convenience of description. FIGS. 7A and 7B are diagrams for illustrating the detailed configuration of an opposite wall surface portion 25*c*. FIG. 7A is a view of the opposite wall surface portion 25*c*, observed in the X-axis positive direction. FIG. 7B is a partial enlarged view of FIG. 7A. FIG. 8 is a sectional view taken along the line VIII-VIII of FIG. 6A.

As shown in FIG. 6A, the holder 20 has a concave shape in which a part of the holder 20 is opened so that the cartridge 10 may be attached or detached. The holder 20 includes a device-side bottom wall surface portion (also called a "bottom surface portion") 25*a*, an engagement-side wall surface portion (a "front surface portion") 25*b*, an opposite wall surface portion (also called a "rear surface portion") 25*c*, a first device-side side wall surface portion (also called a "left side surface portion") 25*e*, and a second device-side side wall surface portion (also called a "right side surface portion") 25*f*. By means of these wall surface portions 25*a*, 25*b*, 25*c*, 25*e* and

25*f*, a cartridge receiving chamber for receiving the cartridge 10 is formed. Each wall surface portion 25*a*, 25*b*, 25*c*, 25*e* and 25*f* is made of a synthetic resin such as polypropylene.

The device-side bottom wall surface portion 25*a* configures a lower surface with respect to a usage posture of the printer 1. The opposite wall surface portion 25*c*, the engagement-side wall surface portion 25*b*, the first device-side side wall surface portion 25*e* and the second device-side side wall surface portion 25*f* stand from the device-side bottom wall surface portion 25*a*. The opposite wall surface portion 25*c* and the engagement-side wall surface portion 25*b* are opposite to the first device-side side wall surface portion 25*e* and the second device-side side wall surface portion 25*f*.

The liquid supply tube 240 and the seal member 242 are mounted to the device-side bottom wall surface portion 25*a*. One end of the liquid supply tube 240 is connected to a print head 21 (FIG. 8) mounted to the rear surface (the surface in the Z-axis negative direction) of the device-side bottom wall surface portion 25*a*. In addition, when the cartridge 10 is mounted to the holder 20, the other end of the liquid supply tube 240 is connected to the liquid supply hole 110 (FIG. 3A) of the cartridge 10. The seal member 242 is a member with elasticity such as a synthetic resin. The seal member 242 is disposed around the liquid supply tube 240 so as to prevent the ink from leaking out when the cartridge 10 is mounted to the holder 20. In addition, as shown in FIG. 8, a porous metallic filter 240*t* partially contacting the foam 112 (FIG. 4A) in the liquid supply hole 110 is installed at the other end of the liquid supply tube 240. This filter 240*t* may employ for example a stainless steel mesh or a stainless steel non-woven fabric. In addition, the filter 240*t* may be excluded.

As shown in FIG. 6B, four through holes 290 (only three through holes are shown in the figure) and four first device-side regulating units 270 (only three first device-side regulating units are shown in the figure) are installed at the device-side bottom wall surface portion 25*a* in correspondence with the number (four) of the cartridges 10 mounted. Further, four contact mechanisms 280 (only three contact mechanisms are shown in the figure) are disposed at the device-side bottom wall surface portion 25*a* in correspondence with the number of the cartridges 10 mounted.

The through holes 290 are used for detecting the remaining amount of ink in the cartridge 10 by using an optical detection device, described later, installed to the Z-axis negative direction side of the holder 20. Specifically, the through holes 290 allow the light emitting from the optical detection device to transmit therethrough and allow the light reflected by the cartridge 10 to transmit therethrough.

The first device-side regulating unit 270 has a protrusion shape. In addition, the first device-side regulating unit 270 has a shape sharpened upwards. The notch 140 serving as the first regulating unit of the cartridge 10 is inserted into the first device-side regulating unit 270 to regulate the movement of the cartridge 10 in the width direction (the Y-axis direction). In addition, the first device-side regulating unit 270 is also called a regulation pin 270. The regulation pin 270 may be formed integrally with the holder 20 as in this embodiment or may be mounted to the device-side bottom wall surface portion 25*a* as a separate unit.

The contact mechanism 280 is used for electrically connecting the control unit 60 of the printer 1 to the circuit board 130 of the cartridge 10. The contact mechanism 280 includes a plurality of electric contact members (also called "terminals") 280*a* to 280*i* for contacting the terminals 130*a* to 130*i* of the circuit board 130. The number of the electric contact members 280*a* to 280*i* corresponds to the number of the terminals 130*a* to 130*i* (FIG. 5A) of the circuit board 130, which is nine in this embodiment. In addition, the contact mechanisms 280 are electrically connected to the control unit 60.

Further, the holder 20 has a device-side engagement unit 260 disposed adjacent to the engagement-side wall surface portion 25*b*. The device-side engagement unit 260 is located at a predetermined height from the device-side bottom wall surface portion 25*a*. The device-side engagement unit 260 is engaged with the container-side regulating unit 124 (FIG. 3B) of the cartridge 10 in order to regulate the movement of the cartridge 10 in the height direction when the cartridge 10 is mounted.

As shown in FIG. 7A, the opposite wall surface portion 25*c* includes a standing wall portion 216, a guide channel 200*t*, and a hole portion 202 formed in the standing wall portion 216. With respect to the usage posture, the standing wall portion 216 extends upwards (in the Z-axis positive direction) from the device-side bottom wall surface portion 25*a*. The standing wall portion 216 includes an opposite surface 216*u*, an extension surface 216*t*, and an upper surface 216*s* in the order from the below. With respect to the usage posture, the opposite surface 216*u* extends right upwards from the device-side bottom wall surface portion 25*a*. In other words, the opposite surface 216*u* forms a surface approximately parallel with the outer surface of the third wall surface portion 100*c* (FIG. 3A) of the cartridge 10 with respect to the mounted state where the cartridge 10 is mounted to the holder 20. For easier understanding, a single hatching is given to the opposite surface 216*u*.

The extension surface 216*t* extends out of the holder 20 from the upper end of the opposite surface 216*u*. In other words, with respect to the mounted state, the extension surface 216*t* extends in a direction away from the outer surface of the third wall surface portion 100*c* (FIG. 3A) of the cartridge 10. In this embodiment, the extension surface 216*t* configures a slanted surface which is slanted with respect to the vertical direction. In addition, the opposite wall surface portion 25*c* has a rotation point 216*w* corresponding to the rotation point 166*w* of the cartridge 10. The rotation point 216*w* is regulated by the border between the opposite surface 216*u* and the extension surface 216*t*. In other words, the rotation point 216*w* may be also called the upper end of the opposite surface 216*u*.

The upper surface 216*s* extends upwards from the lower end of the extension surface 216*t* with respect to the usage posture of the printer 1. The upper surface 216*s* is also slanted with respect to the vertical direction, similar to the extension surface 216*t*.

As shown in FIG. 8, by forming the opposite surface 216*u*, the extension surface 216*t* and the upper surface 216*s*, a space portion 216*sp* in which the cartridge 10 may be partially received when the cartridge 10 is turned and detached is formed.

Referring to FIGS. 7A and 7B again. The protrusion unit 160 (FIG. 3A) of the cartridge 10 is inserted into the approximately spherical hole portion 202. By doing so, with respect to the mounted state, the movement of the cartridge 10 in the width direction (the Y-axis direction) and the height direction (Z-axis direction) are regulated within a predetermined range. In addition, the width Wb of the hole portion 202 is approximately identical to the width Wt of the protrusion unit 160 of the cartridge 10. In addition, for the attaching/detaching operation of the cartridge 10 to/from the holder 20 by the rotating operation described later, the gap of the protrusion unit 160 (FIG. 3C) of the cartridge 10 in the hole portion 202 of the holder 20 in the height direction is greater than the gap in the width direction.

The guide channel 200*t* guides the protrusion unit 160 to the hole portion 202 while regulating the movement of the cartridge 10 in the width direction when the cartridge 10 is mounted to the holder 20. As shown in FIG. 7B, the guide channel 200*t* is formed from the upper end of the opposite wall surface portion 25*c* over the hole portion 202. In addition, for easier understanding, in FIG. 7B, a single hatching is given to the hole portion 202. By providing the guide channel 200*t*, there is no necessity to provide another embodiment such as a partition wall for positioning the cartridge 10 to the holder 20, and therefore the holder 20 may become smaller. In addition, the upper end of the guide channel 200*t* may not be located at the upper end of the opposite wall surface portion 25*c* but may be located in a middle of the opposite wall surface portion 25*c* in the height direction.

The width Wa of the upper end 200*ta* of the guide channel 200*t* is greater than the width Wb of the lower end 200*tb*. In addition, the lower end 200*tb* has the same width as the hole portion 202. In addition, the width Wa of the upper end 200*ta* is greater than the width Wt (FIG. 3C) of the protrusion unit 160 of the cartridge 10. In addition, the width of the guide channel 200*t* is monotonously reduced as the lower end 200*tb* (namely, the hole portion 202) is approached from the upper end 200*ta*. Here, the term "monotonous reduction" means that a region with a consistent width may be included if the width does not increase in any region from the upper end 200*ta* to the lower end 200*tb*. In more detail, the guide channel 200*t* has a lower guide channel 200*tu* which is tapered to have a gradually decreasing width as being closer to the hole portion 202. In addition, a border between the lower guide channel 200*tu* and other parts is depicted with a broken line.

As shown in FIGS. 7A and 8, the opposite wall surface portion 25*c* has a deformation unit 212 which may be elastically deformed in the depth direction (X-axis direction, a direction in which the opposite wall surface portion 25*c* is opposite to the device-side engagement unit 260) of the guide channel 200*t*. In other words, the deformation unit 212 is configured to be deformable toward the outside of the cartridge receiving chamber which receives the cartridge 10. The deformation unit 212 is formed by giving the notches 214 to both ends of a channel bottom wall surface portion 213 which configures the bottom surface of the guide channel 200*t*. The notch 214 is formed through the channel bottom wall surface portion 213. The deformation unit 212 grows over a predetermined height in a central portion of the channel bottom wall surface portion 213 from the region contacting the hole portion 202. The predetermined height represents a region higher than the intersection point where the channel bottom wall surface portion 213 intersects the trajectory of the rotating protrusion unit 160 (FIG. 4A) when the cartridge 10 is mounted in a predetermined method. In addition, the details will be described later.

A-4. Installation of Cartridge

Figure 9A:
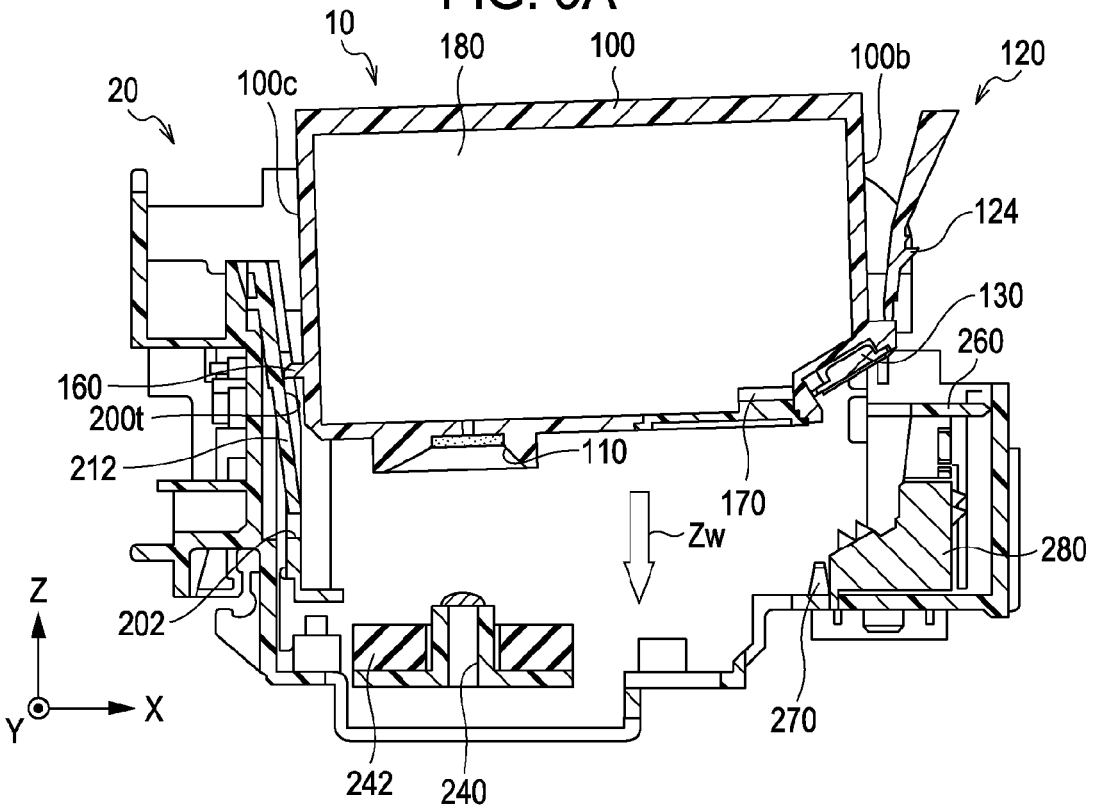
FIGS. 9A and 9B are diagrams for illustrating a mounted state of the cartridge.
Figure 9B:
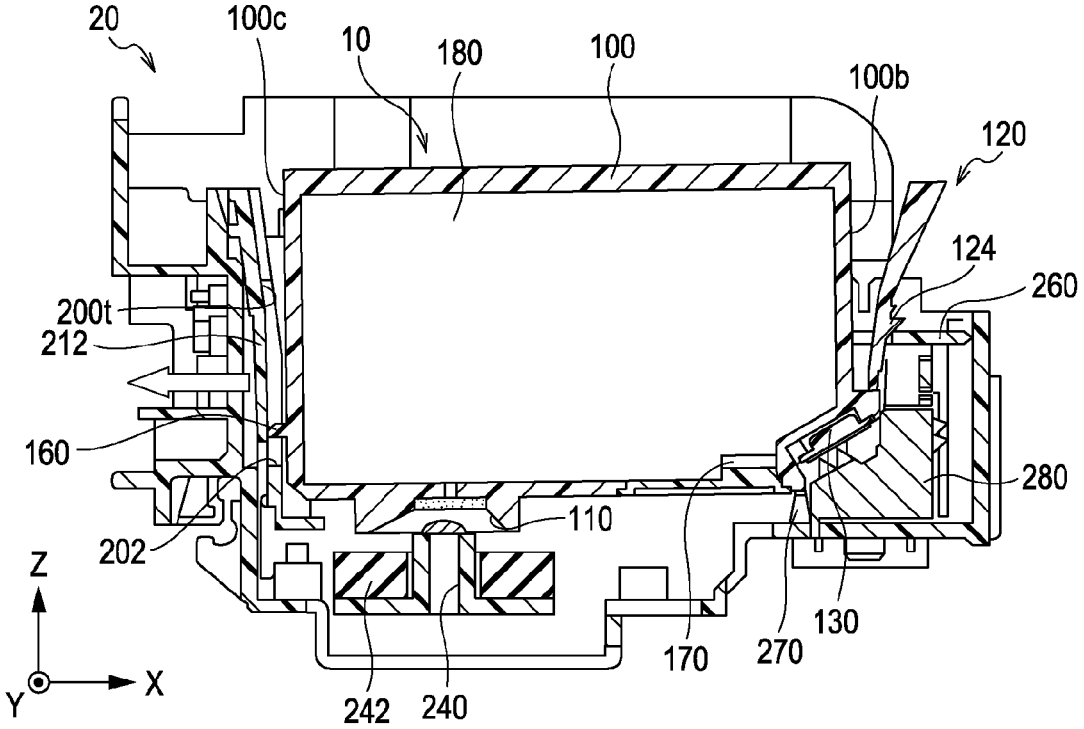

FIGS. 9A and 9B are diagrams for illustrating a mounted state of the cartridge 10 to the holder 20. FIG. 9A is a first view showing that the cartridge 10 is mounted, and FIG. 9B is a second view showing that the cartridge 10 is mounted. FIGS. 9A and 9B show a section of the cartridge 10 taken along the line IX-IX of FIG. 3B and a section of the holder 20 corresponding to the IX-IX section. Hereinafter, a general mounting method (a normal mounting method) which is generally adopted when a user mounts the cartridge 10 to the holder 20 will be described.

In the normal mounting method, as shown in FIG. 9A, the cartridge 10 is mounted to the holder 20 by being slanted so that the protrusion unit 160 of the third wall surface portion 100*c* contacts the opposite wall surface portion 25*c*. In detail, while the protrusion unit 160 is inserted into the guide channel 200*t*, the cartridge 10 is moved to a right lower position represented by the arrow Zw. At this time, since the width Wa of the upper end of the guide channel 200*t* is greater than the width Wt of the protrusion unit 160 of the cartridge 10, the protrusion unit 160 may be easily inserted into the guide channel 200*t*.

As shown in FIG. 9B, in a case where the protrusion unit 160 of the cartridge 10 is moved to a location where the protrusion unit 160 contacts the deformation unit 212 so that an external force is applied to the protrusion unit 160, the deformation unit 212 is elastically deformed toward the outside (X-axis negative direction). As described above, as the deformation unit 212 is elastically deformed, the cartridge 10 may be smoothly mounted to the holder 20.

Figure 10A:
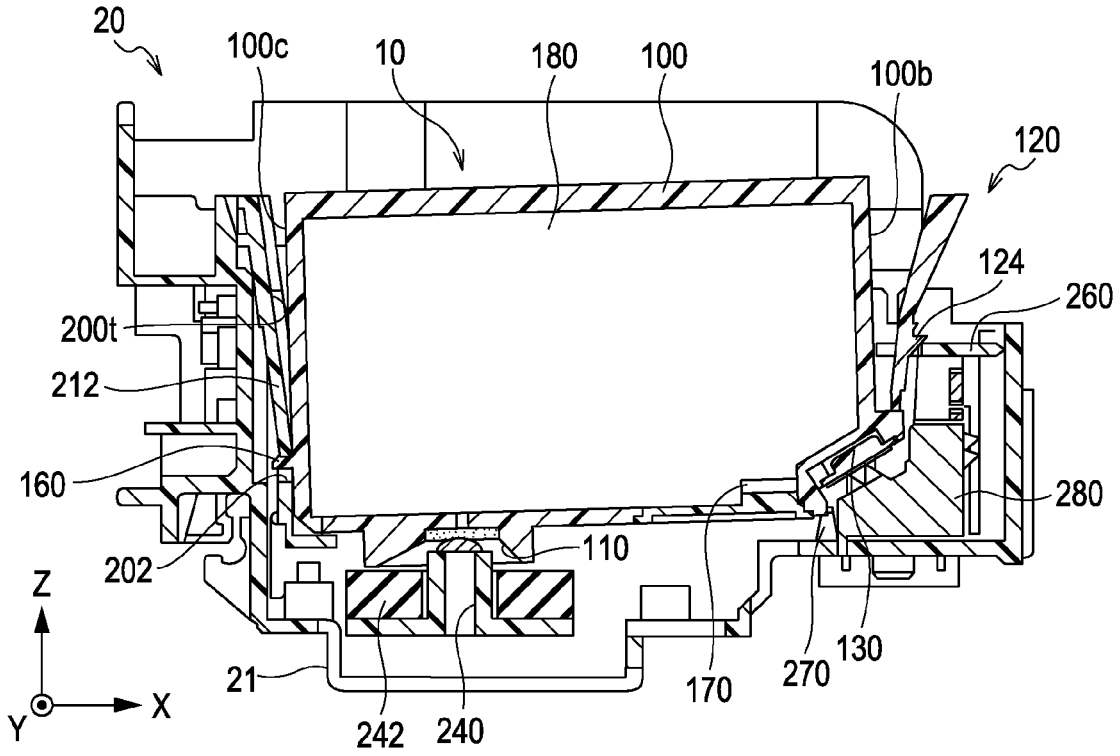
FIGS. 10A and 10B are second diagrams for illustrating a mounted state of the cartridge.
Figure 10B:
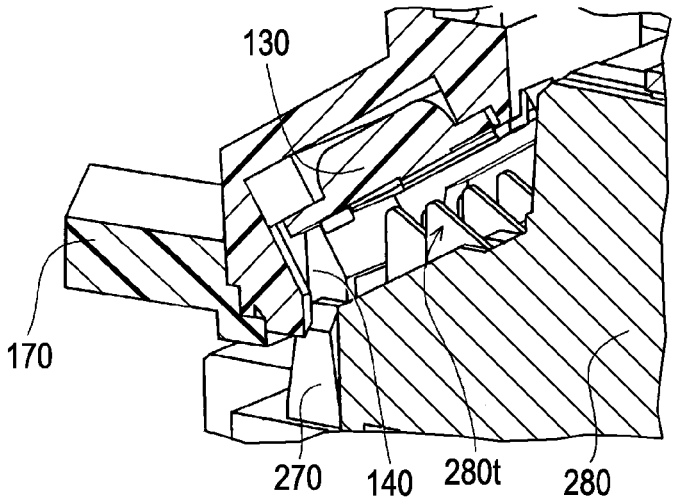

FIGS. 10A and 10B are second views for illustrating a mounted state of the cartridge to the holder. FIG. 10A shows a section of the cartridge 10 taken along the line XA-XA of FIG. 3B and a section of the holder 20 corresponding to the XA-XA section, similar to FIGS. 9A and 9B. In addition, FIG. 10B is a perspective view showing the vicinity of the regulation pin 270 of FIG. 10A.

As shown in FIG. 10A, if the cartridge 10 is moved further to the right lower location, the protrusion unit 160 is easily inserted into the hole portion 202 by the guidance of the guide channel 200*t*. In this state, the container-side regulating unit 124 of the cartridge 10 is not engaged with the device-side engagement unit 260 of the holder 20.

If the protrusion unit 160 is inserted into the hole portion 202, as shown in FIG. 10B, the regulation pin 270 of the holder 20 is inserted into the notch 140 of the cartridge 10. In this state, by pushing the second wall surface portion 100*b* to a right lower position, the container-side regulating unit 124 is engaged with the device-side engagement unit 260. In this pushing operation, since the movement of the second wall surface portion 100*b* to which the circuit board 130 is mounted in the width direction is regulated, the cartridge 10 may be precisely positioned with respect to the holder 20. In other words, after the mounting, the possibility that a device-side terminal 280*t* (though nine terminals are present, it is just called the device-side terminal 280*t* for convenience) of the contact mechanism 280 does not contact each terminal 130*a* to 130*i* (FIGS. 5A and 5B) of the circuit board 130 of the cartridge 10 may be decreased. In addition, since the notch 140 is installed at a location closer to the first wall surface portion 100*a* rather than the circuit board 130, when the cartridge 10 is mounted to the holder 20, the regulation pin 270 is inserted into the notch 140 of the cartridge 10 before each terminal 130*a* to 130*i* of the circuit board 130 contacts the device-side terminal 280*t* of the contact mechanism 280. In other words, in a state where the regulation pin 270 is inserted into the notch 140 and the movement of the cartridge 10 in the width direction (the Y-axis direction) is regulated to some extent, each terminal 130*a* to 130*i* of the circuit board 130 may contact the contact mechanism 280. Therefore, when the cartridge 10 is mounted to the holder 20, each terminal 130*a* to 130*i* may securely contact the contact mechanism 280.

As described above, since the guide channel 200*t* is formed in the opposite wall surface portion 25*c*, the protrusion unit 160 may be easily guided to the hole portion 202. In particular, since the guide channel 200*t* has the lower guide channel 200*tu*, the protrusion unit 160 may be more smoothly guided to the hole portion 202.

Figure 11A:
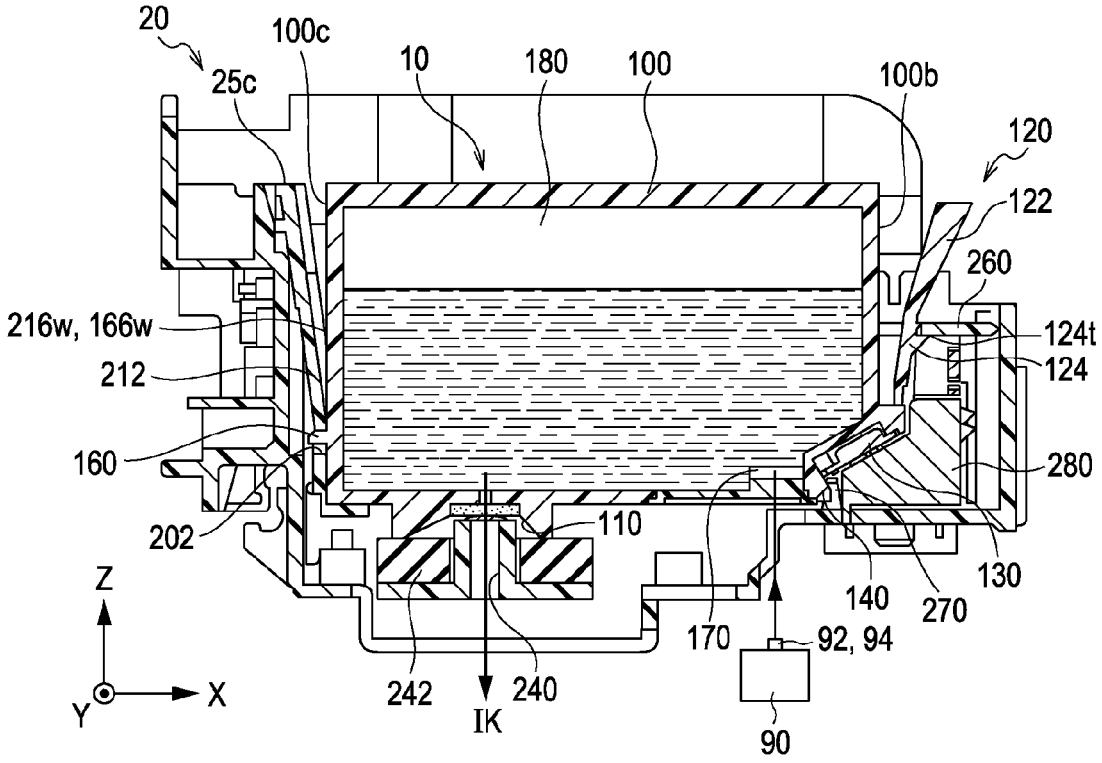
FIGS. 11A and 11B are diagrams for illustrating the state after the mounting.
Figure 11B:
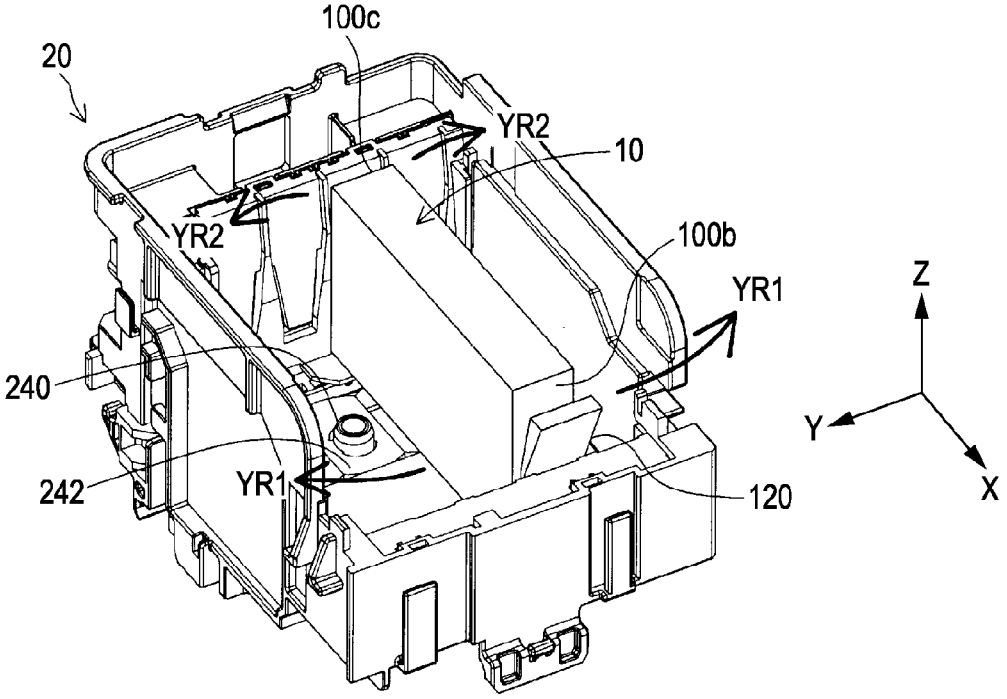

FIGS. 11A and 11B is a diagram for illustrating a state after the mounting. FIG. 11A shows a section of the cartridge 10 taken along the line XIA-XIA of FIG. 3B and a section of the holder 20 corresponding to the XIA-XIA section, similar to FIGS. 9A and 9B. In addition, FIG. 11B is a perspective view showing the mounted state. In FIG. 11A, the ink received in the liquid receiving chamber 180 is depicted with dots.

As shown in FIG. 11A, in the mounted state, the container-side regulating unit 124 is engaged with the device-side engagement unit 260 so that the movement of the cartridge 10 in the height direction is regulated. Here, with respect to the vertical direction (the Z-axis direction) in the usage posture of the holder 20, the rotation point 216*w* is located below an engagement point 124*t*. In the mounted state, the lever 120 is engaged with the device-side engagement unit 260 in a state of being closer to the second wall surface portion 100*b* rather than a non-loaded state. Therefore, the movement of the cartridge 10 in the length direction (the X-axis direction) is regulated as the lever 120 presses the container body 100 to the opposite wall surface portion 25*c*. In addition, in the mounted state, the liquid supply tube 240 is connected to the liquid supply hole 110. In addition, each terminal of the circuit board 130 contacts each corresponding electric contact member 280*a* to 280*i* of the contact mechanism 280 to transmit various kinds of information such as the ink color and the remaining amount of ink between the cartridge 10 and the control unit 60 (FIG. 1) of the printer 1. Further, a remaining amount of ink is detected at a predetermined timing by using the optical detection device 90. In addition, in the mounted state, the ink is supplied to the print head 21 via the liquid supply hole 110 and the liquid supply tube 240 by the suction of the print head 21.

With respect to the mounted state, the movement of the cartridge 10 is generally regulated by the hole portion 202 of the holder 20, the device-side engagement unit 260 and the regulation pin 270. In detail, the hole portion 202 and the protrusion unit 160 cooperate to regulate the movement in the width direction (the Y-axis direction) and the height direction (the Z-axis direction) of the third wall surface portion 100*c*, the device-side engagement unit 260 and the container-side regulating unit 124 cooperates to regulate the movement in the height direction of the second wall surface portion 100*b*, and the regulation pin 270 and the notch 140 cooperate to regulate the movement in the width direction of the second wall surface portion 100*b*.

Here, to perform the printing process or the like, the holder 20 and the cartridge 10 move in the main scanning direction (the Y-axis direction, or the width direction of the cartridge 10). In other words, the cartridge 10 receives an external force (an inertial force) in the width direction. Since the cartridge 10 receives an external force, as shown in FIG. 11B, the cartridge 10 rotates in a rotation direction with a width directional component centered around the liquid supply hole 110 (FIG. 11A). In detail, the second wall surface portion 100*b* rotates in the direction of the arrow YR1, and the third wall surface portion 100*c* rotates in the direction of the arrow YR2. Here, the circuit board 130 is installed to the second wall surface portion 100*b*. Therefore, by providing the notch 140 for regulating the movement in the width direction to the second wall surface portion 100*b*, the movement (distortion) of the circuit board 130 with respect to the holder 20 may be suppressed rather than by providing the notch 140 to the first wall surface portion 100*a*. By doing so, the electric connection between the circuit board 130 (in detail, the terminal group 130*t*) and the printer 1 may be maintained in a good state after the mounting. In particular, in this embodiment, as described above, the circuit board 130 is disposed to partially overlap with the notch 140 in the length direction (FIG. 3A). Therefore, the movement (misalignment) of the circuit board 130 (in detail, the terminal group 130*t*) with respect to the holder 20 may be suppressed to the minimum. Further, as described above, the notch 140 is more preferably installed to overlap with a part of the terminal group 130*t* of the circuit board 130 with respect to the length direction (the X-axis direction). By doing so, the movement (misalignment) of the terminal group 130*t* with respect to the holder 20 may be further suppressed to the minimum.

In addition, in a case where a channel for regulating the movement in the width direction is provided to the first wall surface portion (the bottom surface portion) 100*a*, a member for forming (defining) the channel is required peripherally. In this embodiment, the notch 140 for regulating the movement in the width direction is provided to the second wall surface portion 100*b* so that the size of the cartridge in the length direction (the X-axis direction) may be reduced.

In addition, the notch 140 may suppress the movement of the prism 170 in the width direction by cooperating with the regulation pin 270. In particular, in this embodiment, the prism 170 is disposed in contact with the inner surface of the second wall surface portion 100*b* having the notch 140 (FIG. 4A). By doing so, the movement (misalignment) of the prism 170 in the width direction may be suppressed to the minimum so that the remaining amount of ink may be detected with good precision. Further, the possibility that the flow of the ink flowing toward the liquid supply hole 110 is blocked by the prism 170 may be decreased. By doing so, the ink in the liquid receiving chamber 180 may be consumed efficiently, which may reduce the remaining amount of ink.

In addition, by forming the notch 140 as the first regulating unit, when the cartridge 10 is attached to or detached from the holder 20, the possibility that the first regulating unit (the notch 140) interferes the holder 20 may be decreased, rather than the case where the first regulating unit has a protrusive shape (in this case, the first device-side regulating unit 270 has a concave state). By doing so, the occurrence of any inconvenience such as the breakdown of the cartridge 10 or the holder 20 may be suppressed.

As described above, since the cartridge 10 has the notch 140 for regulating the movement in the width direction at the second wall surface portion 100*b* to which the circuit board 130 is mounted, a misalignment of the circuit board 130 to the holder 20 may be suppressed. Therefore, the possibility that the electric connection between the circuit board 130 and the printer 1 is blocked may be decreased. In addition, since the misalignment of the circuit board 130 to the holder 20 may be suppressed, many terminals may be provided by the circuit board 130. By doing so, it becomes possible to transmit more information between the circuit board 130 and the printer 1.

A-5. Detachment of Cartridge

Figure 12A:
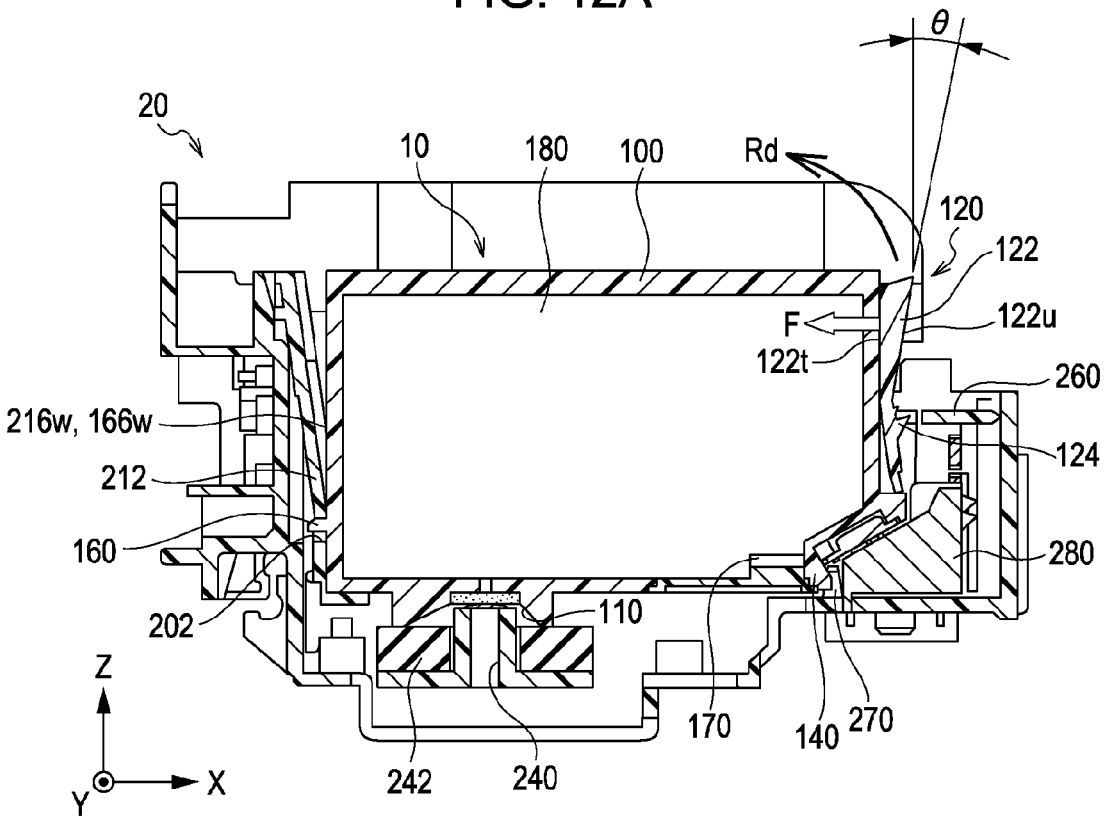
FIGS. 12A and 12B are diagrams for illustrating a detached state of the cartridge.
Figure 12B:
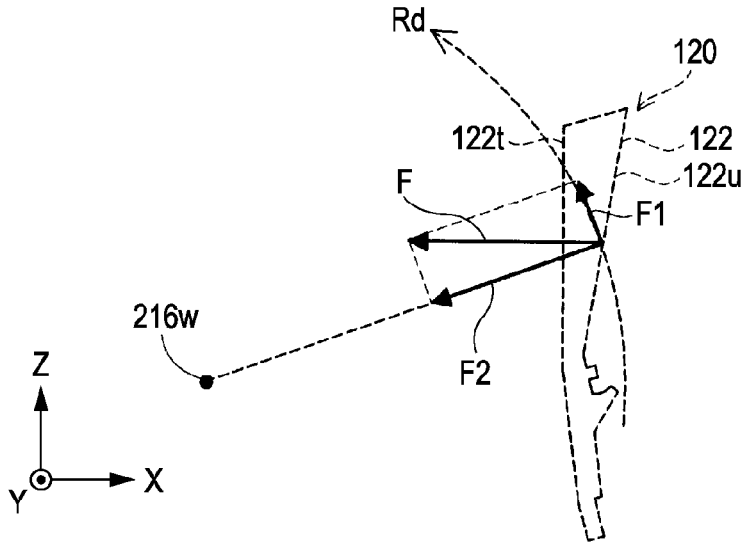

FIGS. 12A and 12B are diagrams for illustrating a detached state of the cartridge 10 from the holder 20. FIG. 12A is a first view showing a detaching posture, and FIG. 12B is a view for illustrating one of the effects of this embodiment. In addition, FIG. 12A shows a section of the cartridge 10 taken along the line XIIA-XIIA of FIG. 3B and a section of the holder 20 corresponding to the XIIA-XIIA section.

As shown in FIG. 12A, in order to detach the cartridge 10 from the holder 20, the engagement releasing unit 122 is elastically deformed in an approaching (pressing) direction (the X-axis negative direction) toward the container body 100 (in detail, the second wall surface portion 100*b*). Then, the engagement of the device-side engagement unit 260 and the container-side regulating unit 124 is released. The engagement releasing unit 122 is formed so that the second side surface 122*u* is slanted a predetermined angle θ from the vertical direction, in a case where the first side surface 122*t* contacts the second wall surface portion 100*b*. By forming the engagement releasing unit 122 as described above, if an external force F is added to the engagement releasing unit 122 in the X-axis negative direction, the engagement may be released and at the same time the cartridge 10 may be detached from the holder 20 efficiently. The reason will be described with reference to FIG. 12B.

As shown in FIG. 12B, in order to release the engagement, the case where an external force F is added to the engagement releasing unit 122 in the approaching direction (the X-axis negative direction) in which the engagement releasing unit 122 approaches the container body 100 (in detail, the second wall surface portion 100*b*) is considered. The external force F may be decomposed into a force F1 of a tangential component of a circumference based on the rotation point 216*w* and a radial component F2. If the second side surface 122*u* is slanted (slanted downwards) to be closer to the rotation point 216*w* from the upper end to the lower end, the force F1 of the tangential component may be efficiently transferred to the engagement releasing unit 122. Therefore, in a case where the external force is added to the engagement releasing unit 122 in the direction (the X-axis negative direction) in which the engagement of the container-side regulating unit 124 and the device-side engagement unit 260 is released, the engagement may be released and the cartridge 10 may be easily rotated in a direction (the arrow Rd) in which the cartridge 10 is detached.

Figure 13A:
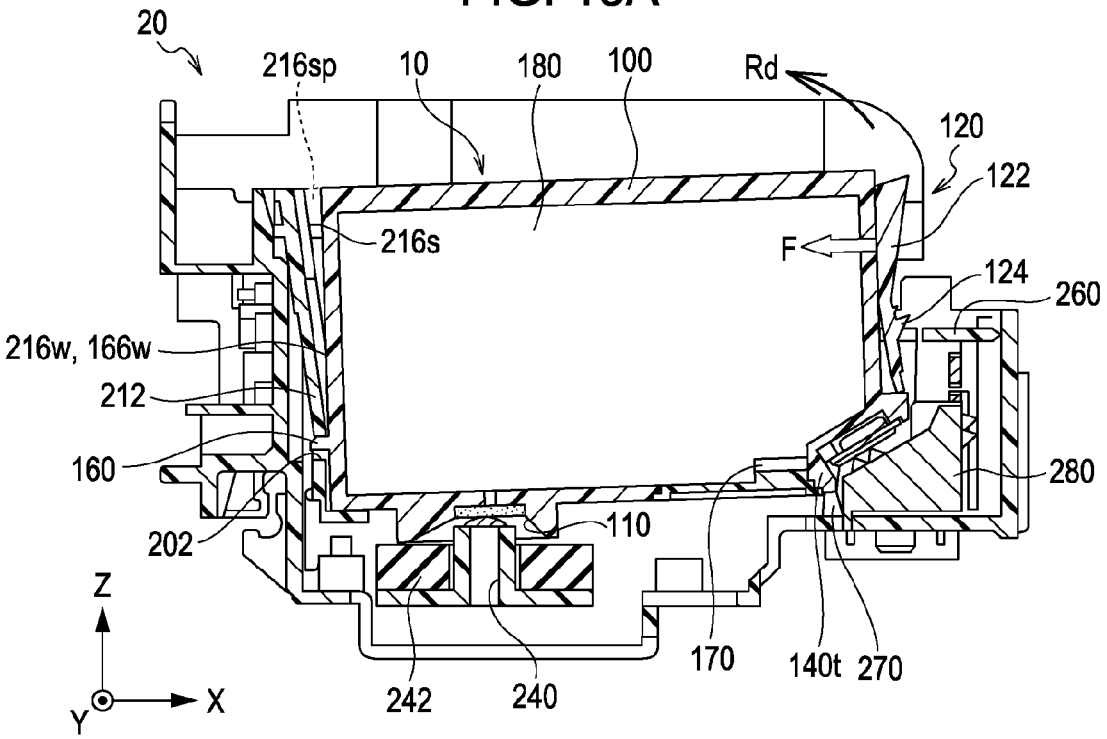
FIGS. 13A and 13B are second diagrams for illustrating a detached state of the cartridge.
Figure 13B:
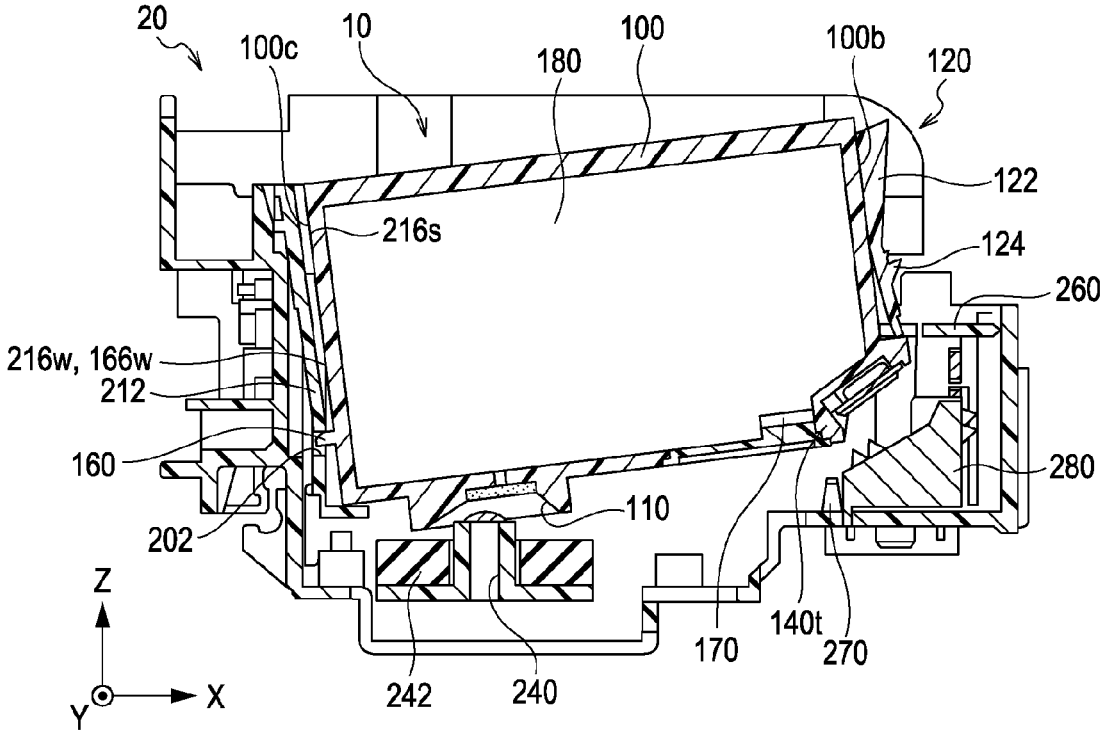

FIGS. 13A and 13B are second views for illustrating a posture of detaching the cartridge 10 from the holder 20. FIG. 13A is a view showing that the cartridge 10 rotates centered around the rotation point 216*w*. FIG. 13B is a second view showing that the cartridge 10 rotates centered around the rotation point 216*w*. In addition, FIGS. 13A and 13B show a section of the cartridge 10 taken along the line XIII-XIII of FIG. 3B and a section of the holder 20 corresponding to the XIII-XIII section.

As shown in FIG. 13A, if an external force F of a predetermined directional component (the X-axis negative directional component) is added to the engagement releasing unit 122, the cartridge 10 is rotated in the direction of the arrow Rd centered around the rotation point 216*w*. In addition, since the space portion 216*sp* is located above the rotation point 216*w*, the rotation of the cartridge 10 in the predetermined direction is not disturbed by the holder 20.

As shown in FIG. 13B, if the rotation in the predetermined direction is performed, the third wall surface portion 100*c* of the cartridge 10 contacts the upper surface 216*s*. In this state, the rotation in the predetermined direction is interfered since the upper surface 216*s* becomes a barrier. However, in this state, a user may easily grip and handle the second wall surface portion 100*b* of the cartridge 10 so that the second wall surface portion 100*b* may be lifted up in the vertical direction with respect to the holder 20.

As described above, the cartridge 10 is configured so that the rotation point 166*w* is located below the engagement point 124*t* and the engagement releasing unit 122 is located above the engagement point 124*t* (FIG. 11A). Therefore, as shown in FIG. 12A, by applying an external force in a predetermined direction (the X-axis negative direction) to the engagement releasing unit 122, the cartridge 10 may be easily detached from the holder 20 at the rotation point 216*w*. In other words, the manipulation for releasing the engagement of the container-side regulating unit 124 and the device-side engagement unit 260 and the manipulation for detaching the cartridge 10 from the holder 20 may be performed in series (FIGS. 12A to 13B). Therefore, a user may be provided with the holder 20 and the ink cartridge 10 with an improved releasing manipulation. In addition, the rotation point 216*w* of the holder 20 may be easily defined by the opposite surface 216*u* and the extension surface 216*t* of the opposite wall surface portion 25*c*.

A-6. Installation of Cartridge in Various Methods

Figure 14A:
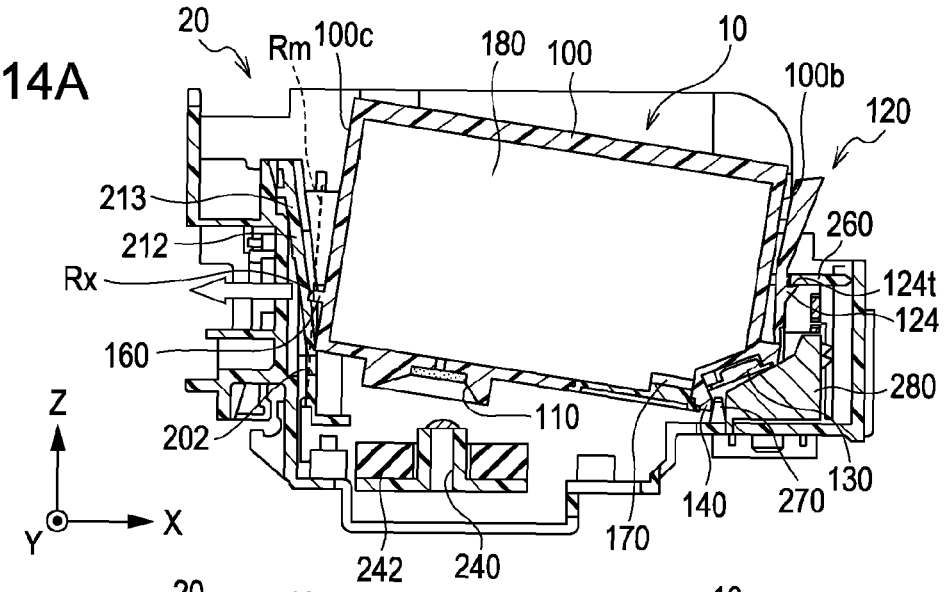
FIGS. 14A to 14C are diagrams for illustrating a mounting manner in a separate method.
Figure 14B:
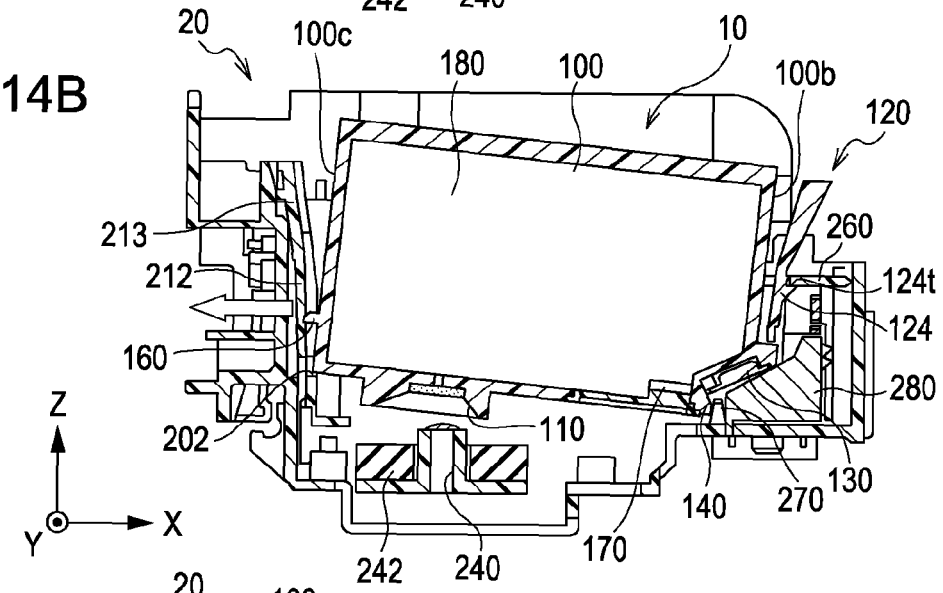
Figure 14C:
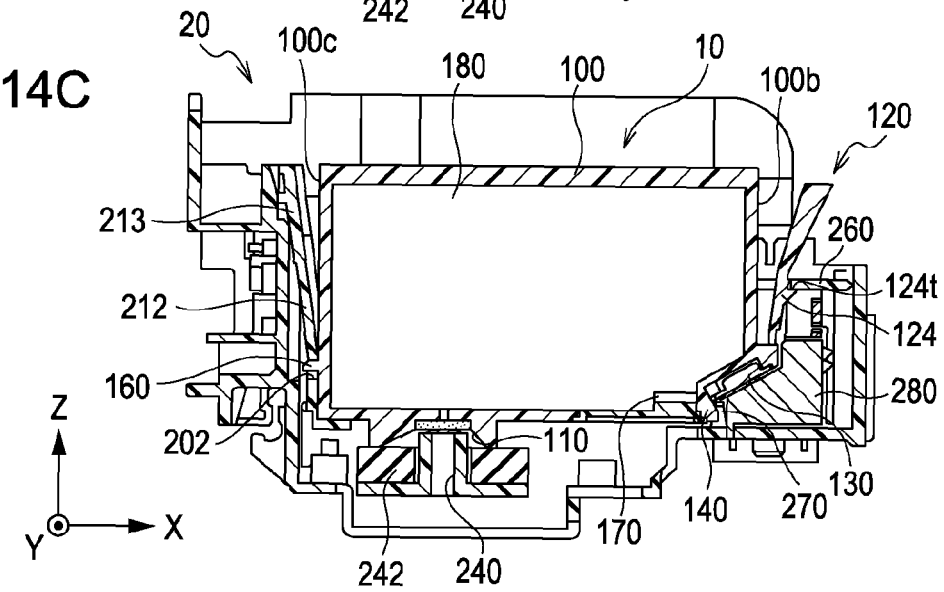

FIGS. 14A to 14C are diagrams for illustrating various mounting methods. FIGS. 14A to 14C are depicted in time series. In addition, FIGS. 14A to 14C show a section of the cartridge 10 taken along the line XIV-XIV of FIG. 3B and a section of the holder 20 corresponding to the XIV-XIV section. With reference to FIGS. 14A to 14C, a mounting method (an engagement mounting method) for slanting the cartridge 10 so that the second wall surface portion 100*b* is located right below the third wall surface portion 100*c* and therefore being inserted into the holder 20 will be described.

As shown in FIG. 14A, in the engagement mounting method, before the protrusion unit 160 is inserted into the hole portion 202, the container-side regulating unit 124 is engaged with the device-side engagement unit 260. In this case, the cartridge 10 is mounted to the holder 20 by rotating the cartridge 10 centered around the engagement point 124*t* as the rotation point. At this time, the protrusion unit 160 moves along a rotating trajectory Rm. This rotating trajectory Rm intersects the deformation unit 212. In other words, the deformation unit 212 is located at the point where the rotating trajectory Rm intersects the holder 20. In other words, with respect to the usage posture, the deformation unit 212 is formed at the center of the channel bottom wall surface portion 213 to reach a location higher than the cross point Rx where the rotating trajectory Rm intersects the channel bottom wall surface portion 213. As shown in FIG. 14A, in a state just after the protrusion unit 160 contacts the channel bottom wall surface portion 213, the protrusion unit 160 contacts the deformation unit 212.

As shown in FIG. 14B, if the third wall surface portion 100*c* is pushed downwards in the vertical direction, the deformation unit 212 is pushed in the outer direction (the X-axis negative direction) of the holder 20 by the protrusion unit 160 and is elastically deformed. As the deformation unit 212 is elastically deformed, the third wall surface portion 100*c* may be pushed downwards in the vertical direction without restricting the movement of the cartridge 10. By doing so, as shown in FIG. 14C, the cartridge 10 may be mounted to the holder 20.

Figure 15A:
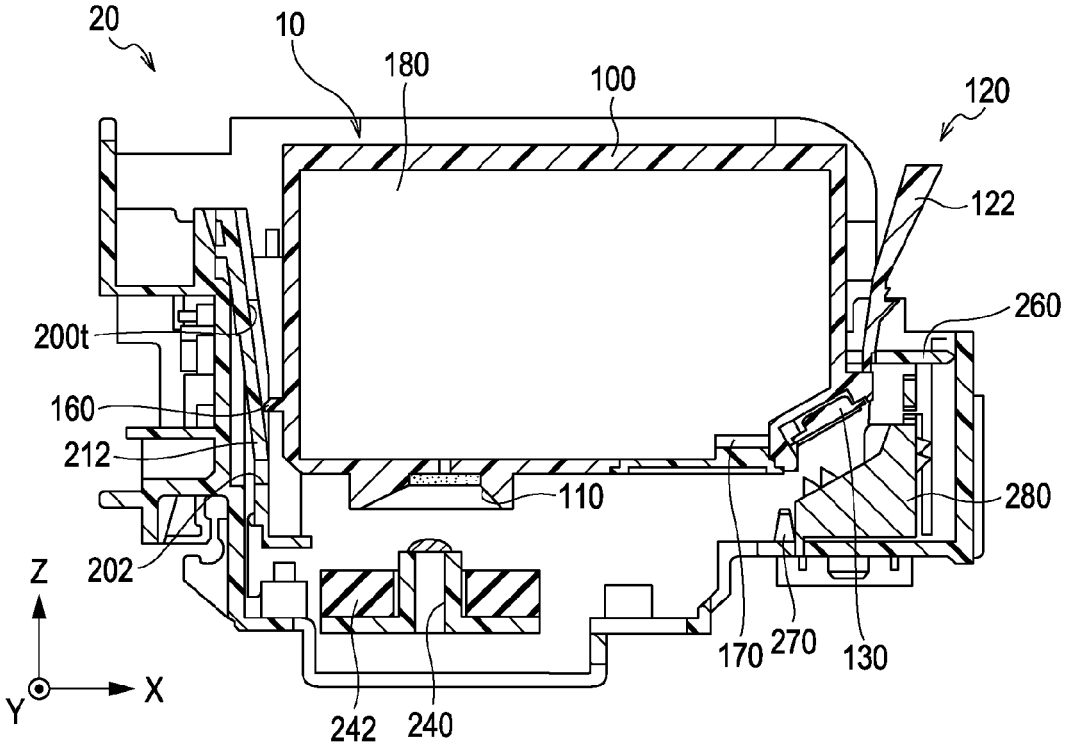
FIGS. 15A and 15B are diagrams for illustrating a mounting manner in a separate method.
Figure 15B:
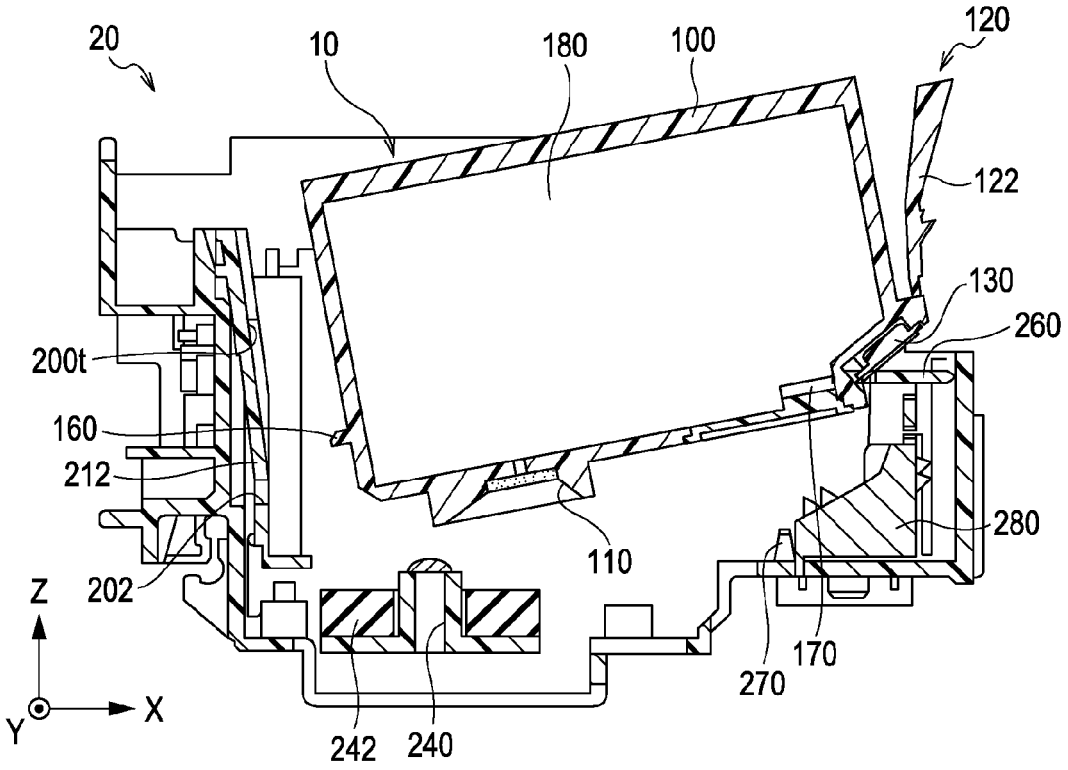

FIGS. 15A and 15B are diagrams for illustrating various mounting methods. FIG. 15A is a first view for illustrating a mounting method to the holder 20. FIG. 15B is a second view for illustrating the mounting method to the holder 20. FIGS. 15A and 15B show a section of the cartridge 10 taken along the line XV-XV of FIG. 3B and a section of the holder 20 corresponding to the XV-XV section.

FIG. 15A shows a mounting method (an upper side access mounting method) for mounting the cartridge 10 to the holder 20 from a location just above the holder 20 without slanting the cartridge 10. Even in this mounting method, since the deformation unit 212 may be elastically deformed, the cartridge 10 may be mounted to the holder 20 without restricting the movement of the cartridge 10.

FIG. 15B shows a mounting device (a front access mounting method) for mounting the cartridge 10 to the holder 20 without inserting the protrusion unit 160 to the guide channel 200*t*. In this embodiment, since the holder 20 has the deformation unit 212, the possibility that the movement of the cartridge 10 is restricted so that the cartridge 10 may not be mounted to the holder 20 may be decreased. Therefore, a method for preventing the mounting in a specific mounting method (a mounting method in which the movement is restricted or the like) may not be provided to the passage of the holder 20. Therefore, the cartridge 10 may also be mounted to the holder 20 according to the front access mounting method.

As described, as the holder 20 has the deformation unit 212, before the cartridge 10 is mounted to the holder 20, the possibility that the movement of the cartridge 10 is restricted in the holder 20 may be decreased. By doing so, it is not necessary to provide a mechanism for prohibiting a specific mounting method to the passage of the holder 20, and therefore the manipulation when mounting the cartridge 10 to the holder 20 may be improved while decreasing the number of parts of the holder 20. In other words, a user may mount the cartridge 10 to the holder 20 using various mounting methods without being limited to any specific mounting method.

B. Second Embodiment

Figure 16A:
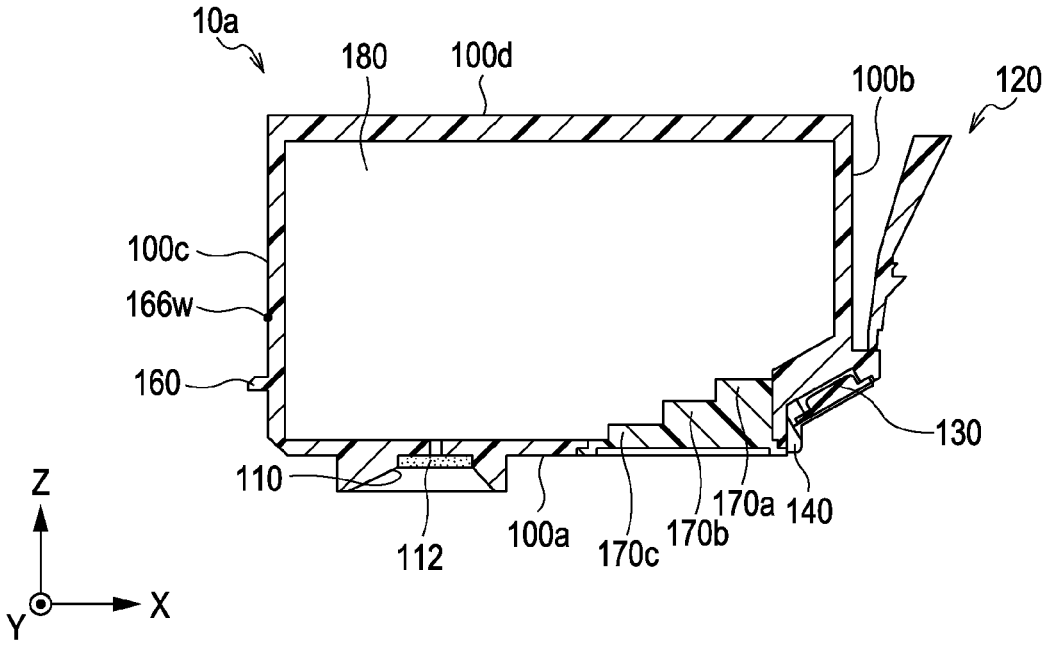
FIGS. 16A and 16B are diagrams for illustrating a cartridge of a second embodiment.
Figure 16B:
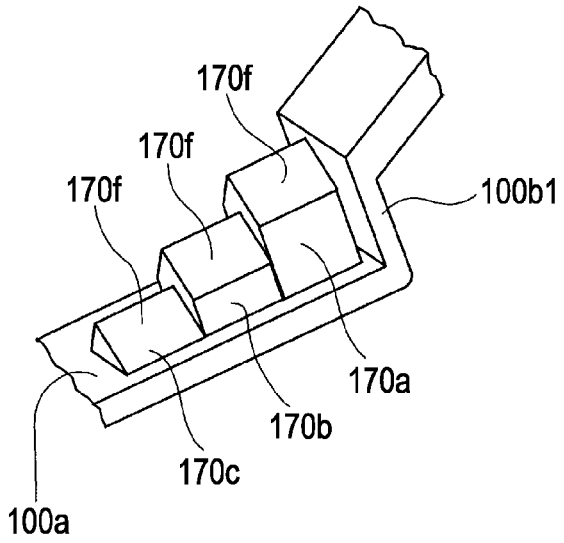
Figure 17A:
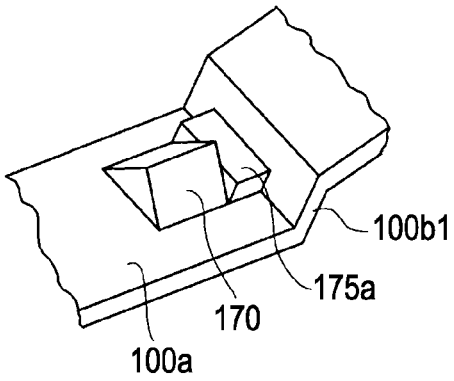
FIGS. 17A to 17E are diagrams for illustrating modified shapes of the first modified example.
Figure 17B:
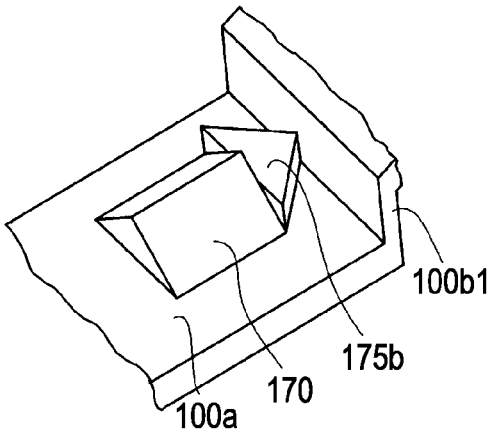
Figure 17C:
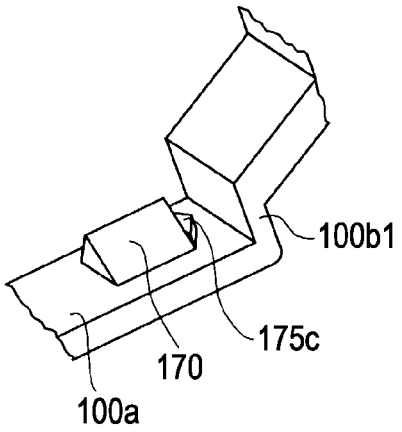
Figure 17D:
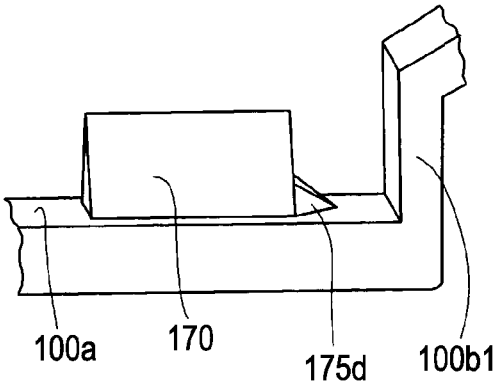
Figure 17E:
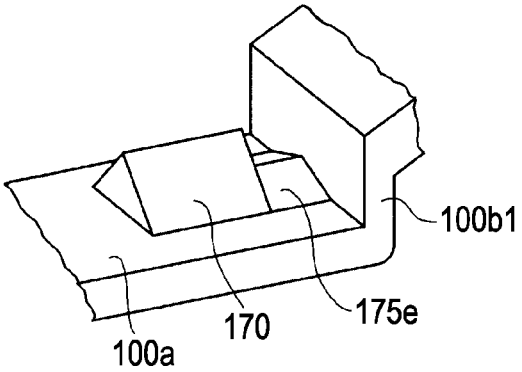

FIGS. 16A and 16B are diagrams for illustrating a cartridge 10*a* of a second embodiment. FIG. 16A is a sectional of the cartridge 10*a*, which corresponds to the XVIA-XVIA section of FIG. 3B. In addition, FIG. 16B is a view for illustrating prisms 170*a* to 170*c* of the cartridge 10*a*. In addition, the prisms 170*a* to 170*c* are different from those of the first embodiment, and other configurations are identical to those of the first embodiment, so the same reference numeral is given to the same component and is not described in detail here. In addition, the configuration of the holder 20 to which the cartridge 10*a* is mounted and the configuration of the printer 1 are identical to those of the first embodiment.

As shown in FIG. 16A, the first to third prisms 170*a* to 170*c* are installed to the first wall surface portion 100*a*. As shown in FIG. 16B, each prism 170*a* to 170*c* includes a portion with a right isosceles triangular prism shape which includes the reflective surface 170*f*. In addition, the prisms 170*a* to 170*c* are disposed to have different distances between the reflective surfaces and the first wall surface portion 100*a*. In detail, the prism closer to the notch 140 is disposed to have a longer distance from the first wall surface portion 100*a*. In other words, among the prisms 170*a* to 170*c*, the first prism 170*a* with a greatest height is disposed to contact the inner surface of the second wall surface portion 100*b* to which the notch 140 is installed. In addition, as the height of the prism is lower, the prism is disposed at a location away from the second wall surface portion 100*b*. By disposing the first to third prisms 170*a* to 170*c* as described above, as the prism is disposed closer to the notch 140, the distance between the reflective surface 170*f* and the optical detection device (not shown) disposed in the Z-axis negative direction is increased. In addition, the number of optical detection devices corresponding to the number of prisms may be disposed to the printer 1 to detect a remaining amount of ink, and a single optical detection device may be moved just below the prisms 170*a* to 170*c* to detect a remaining amount of ink.

As described above, by disposing a plurality of prisms 170*a* to 170*c* whose reflective surfaces 170*f* have different heights, the remaining amount of ink of the cartridge 10*a* may be detected in more detail. In addition, as the distance between the optical detection device and the reflective surface 170*f* is increased, the difference in relative locations of the reflective surface 170*f* and the optical detection device is increased so that the detection precision of the remaining amount of ink tends to be deteriorated. However, in this embodiment, as the distance between the optical detection device and the reflective surface 170*f* is greater, the prism 170*a* is disposed closer to the notch 140 as much so that the distortion with respect to the holder 20 may be suppressed. Therefore, the difference in detection precision on the remaining amount of ink using the prisms 170*a* to 170*c* may be decreased. In addition, since the cartridge 10*a* of the second embodiment has the notch 140 as in the first embodiment, the movement in the width direction (the Y-axis direction) may be regulated in cooperation with the regulation pin 270 of the holder 20. Therefore, the electric connection of the circuit board 130 (in detail, the terminal group 130*t*) and the printer 1 may be maintained in a good state.

C. Modified Examples

In addition, among the components in the above embodiments, components other than those written in an independent claim are additional components, and they may be suitably excluded. In addition, the invention is not limited to the above embodiments or examples, but various modified examples can be made within the scope of the invention as follows for example.

C-1. First Modified Example

Even though the prism 170, 170*a* is disposed in contact with the inner surface of the second wall surface portion 100*b* in the above embodiments (FIGS. 4A and 16A), the prism may be disposed away from the second wall surface portion 100*b* without being limited thereto. Even in this configuration, the movement (misalignment) of the circuit board 130 with respect to the holder 20 may be suppressed. In this case, the following modified examples may be preferably adopted. FIGS. 17A to 17E are diagrams for illustrating modified examples of the first modified example. FIGS. 17A to 17E are diagrams showing the vicinity of the prism 170. The prism 170 is disposed away from the inner surface of the first vertical wall portion 100*b*1, and protrusive members 175*a* to 175*e* are installed between the prism 170 and the first vertical wall portion 100*b*1, different from the first embodiment. Other configurations are identical to those of the first embodiment, and the same configuration is represented with the same reference numeral and is not described in detail here.

The protrusive members 175*a* to 175*e* are protrusions extending from the first wall surface portion 100*a* into the liquid receiving chamber 180. The protrusive member may have a rectangular parallelepiped shape (175*a*, FIG. 17A), a triangular prism shape (175*b* to 175*e*, FIGS. 17B to 17E), or the like. In addition, the protrusive members 175*a*, 175*b* and 175*e* are disposed to contact both of the prism 170 and the first vertical wall portion 100*b*1. By providing the protrusive members 175*a* to 175*e* as described above, it is possible to prevent the ink from being blocked by the prism 170 so that the ink at the first vertical wall portion 100*b*1 is guided to the liquid supply hole 110 (FIG. 4A). Therefore, the ink in the liquid receiving chamber 180 (FIG. 4A) may be efficiently consumed.

C-2. Second Modified Example

Even though the cartridge 10 has the prism 170, 170*a* to 170*c* in order to detect a remaining amount of ink in the above embodiments (FIGS. 4A and 16A), the prisms may be excluded. In addition, instead of the prism used in the optical method for detecting a remaining amount of ink, a sensor using a piezoelectric element or a sensor using an electrode may be adopted to detect a remaining amount of ink. Even in this configuration, the movement (misalignment) of the circuit board 130 with respect to the holder 20 may be suppressed, similar to the above embodiments, as the notch 140 of the cartridge 10 and the regulation pin 270 of the holder 20 cooperate. In addition, similar to the above embodiments, the manipulation for attaching or detaching the cartridge 10 to/from the holder 20 may be improved by means of the rotation point 166*w*, 216*w* or the deformation unit 212 of the holder 20.

C-3. Third Modified Example

Even though the cartridge 10 uses the notch 140 as the first regulating unit in the above embodiments, the shape is not limited thereto. For example, a protrusion may be installed to the second wall surface portion 100*b* as the first regulating unit. In this case, a concave portion in which the protrusion is inserted instead of the regulation pin 270 is provided to the holder 20. Even in this configuration, after mounting, the movement of the cartridge 10, 10*a* in the width direction is controlled, and therefore the electric connection of the circuit board 130 and the printer 1 is maintained in a good state. In addition, even though the notch 140 is installed at the approximate center of the first vertical wall portion 100*b*1 in the width direction (FIG. 3B), the invention is not limited thereto. For example, the notch 140 may be formed at a corner of the first vertical wall portion 100*b*1 in the width direction. In other words, even though both sides of the notch 140 of the above embodiments in the width direction are formed by the first vertical wall portion 100*b*1, it is also possible that only one side is formed by the first vertical wall portion 100*b*1 so that the other side is opened. Even in this configuration, with respect to the mounted state, the movement of the cartridge 10 in the width direction (the movement in the width direction toward any one side thereof) may be regulated so that the misalignment of the circuit board 130 and the holder 20 may be suppressed. In addition, similar to the above embodiments, the manipulation for attaching or detaching the cartridge 10 to/from the holder 20 may be improved by the rotation point 166*w*, 216*w* or the deformation unit 212 of the holder 20.

C-4. Fourth Modified Example

Even though the cartridge 10 is configured so that the second wall surface portion 100*b* has the first vertical wall portion 100*b*1, the slanted wall portion 100*b*2 and the second vertical wall portion 100*b*3 in the above embodiments, the cartridge 10 may have any shape. For example, the cartridge 10 may have an approximately rectangular parallelepiped shape without the slanted wall portion 100*b*2, or the second wall surface portion 100*b* may have a slanted shape as a whole. In addition, each wall surface portion 100*a* to 100*f* may be slanted at a certain angle, and an intersecting angle of the wall surface portions 100*a* to 100*f* may be other than 90 degrees. In other words, the ink cartridge 10 may have any shape if the liquid receiving chamber 180 for receiving an ink may be formed therein.

C-5. Fifth Modified Example

Even though the outer surface of the third wall surface portion 100*c* of the cartridge 10 has the rotation point 116*w* (FIG. 3A) in the above embodiments, a protrusion may be provided to the third wall surface portion 100*c* so that the protrusion is set to the rotation point 166*w*. Even in this configuration, the cartridge 10 may be easily detached from the holder 20 by rotating the cartridge 10 centered around the rotation point 166*w*.

C-6. Sixth Modified Example

Even though the cartridge 10 has the protrusion unit 160 in the above embodiments, the protrusion unit may be excluded. In addition, the guide channel 200*t* or the hole portion 202 (FIGS. 7A and 7B) may also be excluded with respect to the holder 20 correspondingly. Even in this configuration, the manipulation for attaching or detaching the cartridge 10 to/from the holder 20 may be improved by the rotation point 166*w*, 216*w* or the deformation unit 212 of the holder 20, similar to the above embodiments.

C-7. Seventh Modified Example

Even though the guide channel 200*t* of the holder 20 has the tapered lower guide channel 200*tu* in the above embodiments, the invention is not limited thereto. For example, the guide channel 200*t* may have an approximately uniform width. Even in this configuration, the protrusion unit 160 may be easily guided to the hole portion 202 of the holder 20 by the guide channel 200*t*.

C-8. Eighth Modified Example

Even though the terminals of the circuit board 130 are configured in two rows in the above embodiments, the terminals may also be configured in one row or in three or more rows. In addition, in a case where the terminals are configured in three or more rows, the first row closest to the first regulating unit (notch) 140 preferably include more terminals than the second row farthest from the first regulating unit (notch) 140. By doing so, the electric connection between the printer 1 and each terminal included in the first and second rows may be maintained in a good state. In addition, in a case where the terminals are configured in three or more rows, more preferably the closer the row is to the first regulating unit (notch) 140 the more terminals are included. By doing so, the electric connection between the printer 1 and each terminal of the circuit board 130 may be maintained in a good state.

C-9. Ninth Modified Example

Even though the elastic portion (lever) 120 is provided to the second wall surface portion 100*b* of the cartridge 10 in the above embodiments, it is also possible that the container-side regulating unit 124 is formed at the second wall surface portion 100*b* of the cartridge 10 and also the engagement releasing unit 122 is provided to the holder 20. Even in this configuration, the engagement of the holder 20 and the container-side regulating unit 124 may be released by applying an external force to the engagement releasing unit 122 by a user.

C-10. Tenth Modified Example

Even though the circuit board 130 (FIGS. 5A and 5B) having the storage unit 133 and the terminal group 130*t* composed of nine terminals 130*a* to 130*i* disposed at the surface is mounted to the container body 100 in the above embodiments, the terminal group 130*t* may be directly provided to the container body 100. Even in this configuration, the movement (misalignment) of the terminal group 130*t* with respect to the liquid ejecting device (the printer 1) is suppressed so that the contact between the terminal group 130*t* and the liquid ejecting apparatus (the printer 1) may be maintained in a good state. In this case, with respect to the length direction (the X-axis direction), the notch 140 is more preferably installed to the container body 100 to overlap with a part of the terminal group 130*t*. By doing so, the movement (misalignment) of the terminal group 130*t* to the liquid ejecting device (the printer 1) may be further suppressed.

C-11. Eleventh Modified Example

Even though the examples of the cartridge 10, 10*a* used for the printer 1 have been described as the liquid housing container in the embodiments and the modified examples, the invention may be applied to a liquid housing container capable of supplying a liquid to for example a device having a colored material ejecting head such as a liquid crystal display, a device having an electrode material (conductive paste) ejecting head used for forming an electrode of an organic EL display, a surface light-emitting display (FED) or the like, a device having a bio-organic material ejecting head used for producing a bio chip, a device having a test piece ejecting head as a precise pipette, and a liquid ejecting device such as a printing device or a micro dispenser without being limited thereto. In addition, without being limited to the ink cartridge, the invention may be applied to a holder to which various kinds of liquid housing containers may be detachably mounted. In order to use the liquid housing container for the various liquid ejecting devices, liquids (coloring agents, conductive paste, bio organic material, or the like) according to the kind of the liquid ejected by various liquid ejecting devices may be received in the liquid housing container. In addition, the invention may be applied even to various liquid ejecting devices equipped with a holder and a liquid ejecting system having a liquid housing container corresponding to various liquid ejecting devices.

What is claimed is:

1. A cartridge having a liquid receiving chamber configured to receive a liquid therein, the cartridge being configured to be mounted to a holder of a printer and to be detached from the holder by rotation, the holder having a hole portion, a regulating unit, a plurality of electric contact members, and a liquid supply tube covered with a filter, the cartridge comprising:

a first wall surface portion having a liquid supply hole configured to flow the liquid toward the liquid supply tube via the filter;

a second wall surface portion having a concave portion configured to be inserted into by the regulating unit;

a third wall surface portion opposite to the second wall surface portion and having a protrusion portion configured to insert into the hole portion, the liquid supply hole being located at a portion closer to the third wall surface portion than the second wall surface portion;

a fourth wall surface portion opposite to the first wall surface portion; and a terminal group located at the second wall surface portion and configured to be electrically connected the plurality of electric contact members, the concave portion being located at a position closer to the first wall surface portion than the terminal group, wherein, in a condition that a first direction is defined as a direction from the first wall surface portion toward the fourth wall surface portion, a second direction is defined as a direction from the third wall surface portion toward the second wall surface portion and is perpendicular to the first direction, and a third direction is defined as a direction perpendicular to the first and second directions, the first wall surface portion is located, with respect to the liquid receiving chamber, at the first direction, the second wall surface portion is located, with respect to the liquid receiving chamber, at the second direction, the third wall surface portion is located, with respect to the liquid receiving chamber, at a direction that is oppose to the second direction, the fourth wall surface portion is located, with respect to the liquid receiving chamber, at a direction that is opposite to the first direction, the concave portion is opened to the first and second directions, and the movement of the cartridge with respect to the holder in a direction parallel to the third direction is configured to be regulated when the concave portion is inserted into by the regulating unit in a state that the cartridge is mounted to the holder.

2. The cartridge according to claim 1, wherein the concave portion is configured to be inserted into by the regulating unit before the terminal group is electrically connected the plurality of electric contact members when the cartridge is mounted to the holder.

3. The cartridge according to claim 1, wherein a movement of the cartridge with respect to the holder in a direction that is oppose to the first direction is configured to be regulated after the protrusion portion inserts into the hole portion.

4. The cartridge according to claim 1, wherein a movement of the cartridge with respect to the holder in a direction that is oppose to the first direction is configured to be regulated after the protrusion portion inserts into the hole portion, and the terminal group is configured to be electrically connected the plurality of electric contact members after the concave portion is inserted into by the regulating unit and the protrusion portion inserts into the hole portion.

5. The cartridge according to claim 4, wherein the terminal groups is located at a position partially overlapped with a position of the concave portion along a direction parallel to the second direction when viewing the cartridge from a direction that is oppose to the first direction.

6. The cartridge according to claim 5, further comprising:

a foam disposed in the liquid supply hole and configured to be contacted by the filter.

7. The cartridge according to claim 1, wherein the terminal group includes a plurality of terminals, each of the plurality of terminals has a contact portion, a plurality of the contact portions of the terminal group are arranged in a first and second rows, a number of the contact portions in the first row is less than a number of the contact portions in the second row, and the second row is located at a position closer to the concave portion than a position at which the first row is located.

8. The cartridge according to claim 7, wherein the second row includes a contact portion of a grounding terminal among the plurality of terminals.

9. The cartridge according to claim 1, wherein the second wall surface portion has a vertical wall portion and a slanted wall portion, the vertical wall portion stands from the first wall surface portion in a direction parallel to the first direction, the slanted wall portion is slanted with respect to the vertical wall portion, and one end of the second slanted wall portion is connected to the first vertical wall portion.

10. The cartridge according to claim 9, wherein the terminal group is located at the slanted wall portion.

11. The cartridge according to claim 10, wherein the concave portion is located at a center of the vertical wall portion in a direction parallel to the third direction.

12. The cartridge according to claim 1, wherein the second wall surface portion has a first vertical wall portion, a slanted wall portion, and a second vertical wall portion, the first vertical wall portion stands from the first wall surface portion in a direction parallel to the first direction, the slanted wall portion is slanted with respect to the first vertical wall portion, a first end of the second slanted wall portion is connected to the first vertical wall portion, a second end of the second slanted wall portion is connected to the second vertical wall portion, and the second vertical wall portion stands from the second end of the second slanted wall portion in a direction parallel to the first direction.

13. The cartridge according to claim 12, wherein the terminal group is located at the slanted wall portion.

14. The cartridge according to claim 13, wherein the concave portion is located at a center of the first vertical wall portion in a direction parallel to the third direction.

15. The cartridge according to claim 1, further comprising:

a fifth wall surface portion located, with respect to the liquid receiving chamber, at the third direction; and a sixth wall surface portion opposite to the fifth wall surface portion.

* * * * *